US007555252B2

(12) United States Patent
Aruga et al.

(10) Patent No.: US 7,555,252 B2
(45) Date of Patent: Jun. 30, 2009

(54) IMAGE FORMING APPARATUS THAT PREVENTS CONSPICUOUS UNEVENNESS IN IMAGE DENSITY

(75) Inventors: Tomohiro Aruga, Shiojiri (JP); Yoichi Yamada, Shiojiri (JP); Noboru Sakurai, Chino (JP); Takatomo Fukumoto, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 200 days.

(21) Appl. No.: 11/623,669

(22) Filed: Jan. 16, 2007

(65) Prior Publication Data

US 2007/0177908 A1 Aug. 2, 2007

(30) Foreign Application Priority Data

Jan. 17, 2006 (JP) ..... 2006-008821
Jan. 17, 2006 (JP) ..... 2006-008822

(51) Int. Cl.
*G03G 15/08* (2006.01)

(52) U.S. Cl. ..... 399/286

(58) Field of Classification Search ..... 399/286, 399/279, 53

See application file for complete search history.

(56) References Cited

U.S. PATENT DOCUMENTS 4,780,741 A * 10/1988 Wada et al. ..... 399/274
5,387,966 A * 2/1995 Karashima ..... 399/286
5,812,917 A * 9/1998 Iwata et al. ..... 399/281
2007/0110484 A1* 5/2007 Yamada et al. ..... 399/286
2007/0147906 A1* 6/2007 Sakurai et al. ..... 399/286

FOREIGN PATENT DOCUMENTS

JP 01-102486 4/1989
JP 2000-228728 8/2000

* cited by examiner

*Primary Examiner*—Quana M Grainger
(74) *Attorney, Agent, or Firm*—Hogan & Hartson LLP

(57) ABSTRACT

An image forming apparatus includes: an image bearing body that is rotatable about a central axis thereof, and that bears a dot-like latent image, on a surface of the image bearing body, in each of a plurality of divided regions that are arranged in rows along a direction that intersects an axial direction of the central axis at a predetermined intersection angle; and a developer bearing roller that is rotatable in order to make visible, as a developer image, the dot-like latent images borne by the image bearing body, using a developer borne on a surface of the developer bearing roller, the developer bearing roller opposing the image bearing body such that an axial direction of the developer bearing roller is parallel to the axial direction of the image bearing body, and that includes a helical groove portion on the surface of the developer bearing roller, the helical groove portion being inclined at a predetermined inclination angle with respect to the axial direction of the developer bearing roller and being formed having a uniform pitch in the axial direction, wherein a value that is a tangent of the inclination angle divided by a ratio of a moving speed of the surface of the developer bearing roller to a moving speed of the surface of the image bearing body is different from a tangent of the intersection angle.

20 Claims, 23 Drawing Sheets

IMAGE FORMING APPARATUS THAT PREVENTS CONSPICUOUS UNEVENNESS IN IMAGE DENSITY

CROSS-REFERENCE TO RELATED APPLICATIONS

The present application claims priority from Japanese Patent Applications No. 2006-8821 filed on Jan. 17, 2005 and No. 2006-8822, filed on Jan. 17, 2005, which are herein incorporated by reference.

BACKGROUND

1. Technical Field

The present invention relates to image forming apparatuses which are for forming an image.

2. Related Art

Image forming apparatuses such as a laser beam printer have been well-known. Such image forming apparatuses are furnished with, for example, an image bearing body that is for bearing dot-like latent images, and a rotatable developer bearing roller that is for making visible as a developer image, using developer borne on a surface thereof, the dot-like latent images borne by the image bearing body. The image bearing body is rotatable about a central axis, and the developer bearing roller is opposes the image bearing body such that an axial direction thereof is parallel to an axial direction of the image bearing body.

When the image forming apparatus receives image signals, etc. from external devices such as host computers, it positions a developing device at a developing position which is opposite to the image bearing body, and forms a toner image by developing, using toner particles in the developing device, a latent image borne by the image bearing body. The image forming apparatus transfers the toner image onto a medium, and finally forms an image on the medium.

Some of the above-mentioned developer bearing rollers have, on a surface thereof, a helical groove portion which has a predetermined inclination with respect to an axial direction of the developer bearing roller and which is formed having a uniform pitch in the axial direction. When dot-like latent images are made visible as a developer image by the developer which is borne by the developer bearing roller having the groove portion, there are cases in which unevenness in density may occur periodically in the developer image (for example, unevenness in density which is caused because an amount of the developer borne by the groove portion is more than an amount of the developer borne by any other section than the groove portion).

Further, if dot-like latent images are respectively borne by a plurality of divided regions which are arranged in rows along a direction which intersect, at a predetermined intersection angle, an axial direction of the central axis of the image bearing body (hereinafter also referred to as an intersection direction), a plurality of the dot-like latent images that are borne are formed along the intersection direction.

Under such a circumstance, depending on a relative position of each of a plurality of the divided regions with respect to the groove portion, unevenness in density caused by the groove portion may become conspicuous in the developer image which has been made visible. For example, when the image bearing body and the developer bearing roller rotate in order to make dot-like latent images visible as a developer image, if the relative position of each of a plurality of divided regions with respect to the groove portion is the same, each dot-like latent image borne by each of a plurality of the divided regions may be made visible, as a developer image, by the developer borne on a same area of the groove portion. This may make unevenness in density caused by the groove portion conspicuous in the developer image which has been made visible.

Besides, image forming apparatuses such as a laser beam printer are furnished with, for example, a rotatable image bearing body that is for bearing dot-like latent images in divided regions which are divided into lattices, and a rotatable developer bearing roller that bears the developer on a surface thereof and is for making visible, as a developer image, the dot-like latent images borne by the image bearing body. When the image forming apparatus receives image signals, etc. from external devices such as host computers, it positions a developing device at a developing position which is opposite to the image bearing body, and forms a toner image by developing, using the developer in the developing device, a latent image borne by the image bearing body. The image forming apparatus transfers the toner image onto a medium, and finally forms an image on the medium. Besides, the above-mentioned developer bearing roller is furnished with a depressed and projecting section on the surface thereof, in order to bear the developer.

However, if the depressed/projecting section is formed on the surface of the developer bearing roller, when dot-like latent images are made visible as a developer image, there are cases in which unevenness in density caused by the depressed and projecting section may occur periodically in the developer image (for example, unevenness in density which is caused because an amount of developer borne by a projecting portion is different from an amount of developer borne by a depressed portion). Thus, unevenness in density occurring periodically is conspicuous, so that image quality may deteriorate.

Note that JP-A-1-102486 and JP-A-2000-228728 are examples of a related art.

SUMMARY

The present invention has been made in view of the above issues. An object of the present invention is to achieve an image forming apparatus which can prevent unevenness in density from becoming conspicuous.

Another aspect of the present invention is the following image forming apparatus.

An image forming apparatus includes:

an image bearing body that is rotatable about a central axis thereof, and that bears a dot-like latent image, on a surface of the image bearing body, in each of a plurality of divided regions that are arranged in rows along a direction that intersects an axial direction of the central axis at a predetermined intersection angle; and a developer bearing roller that is rotatable in order to make visible, as a developer image, the dot-like latent images borne by the image bearing body, using a developer borne on a surface of the developer bearing roller, the developer bearing roller opposing the image bearing body such that an axial direction of the developer bearing roller is parallel to the axial direction of the image bearing body, and that includes a helical groove portion on the surface of the developer bearing roller, the helical groove portion being inclined at a predetermined inclination angle with respect to the axial direction of the developer bearing roller and being formed having a uniform pitch in the axial direction, wherein a value that is a tangent of the inclination angle divided by a ratio of a moving speed of the surface of the developer bearing roller to a moving speed of the surface of the image bearing body is different from a tangent of the intersection angle.

Another aspect of the present invention is the following image forming apparatus.

An image forming apparatus includes:

a rotatable image bearing body that is for bearing dot-like latent images in divided regions that has been divided into lattices; and a rotatable developer bearing roller that includes a depressed and projecting section on a surface thereof, and that is for making visible, by bearing a developer on the surface, as a developer image the dot-like latent images that are borne by the image bearing body, wherein a positional relationship, in a circumferential direction of the image bearing body, between a center of each of the divided regions and an opposing portion, of the image bearing body, that opposes an axial-direction first portion of the depressed and projecting section when the axial-direction first portion is positioned at a position closest to the image bearing body, the axial-direction first portion being along an axial direction of the developer bearing roller, is different from a positional relationship, in the circumferential direction, between the center of each of the divided regions and an opposing portion, of the image bearing body, that opposes an axial-direction second portion of the depressed and projecting section when the axial-direction second portion is positioned at the position closest to the image bearing body with rotation of the developer bearing roller, the axial-direction second portion being along the axial direction of the developer bearing roller and being a same shape as the axial-direction first portion.

Other features of the present invention will become clear by the accompanying drawings and the description hereinbelow.

BRIEF DESCRIPTION OF THE DRAWINGS

For a more complete understanding of the present invention and the advantages thereof, reference is now made to the following description taken in conjunction with the accompanying drawings.

DESCRIPTION OF EXEMPLARY EMBODIMENTS

Figure 1:
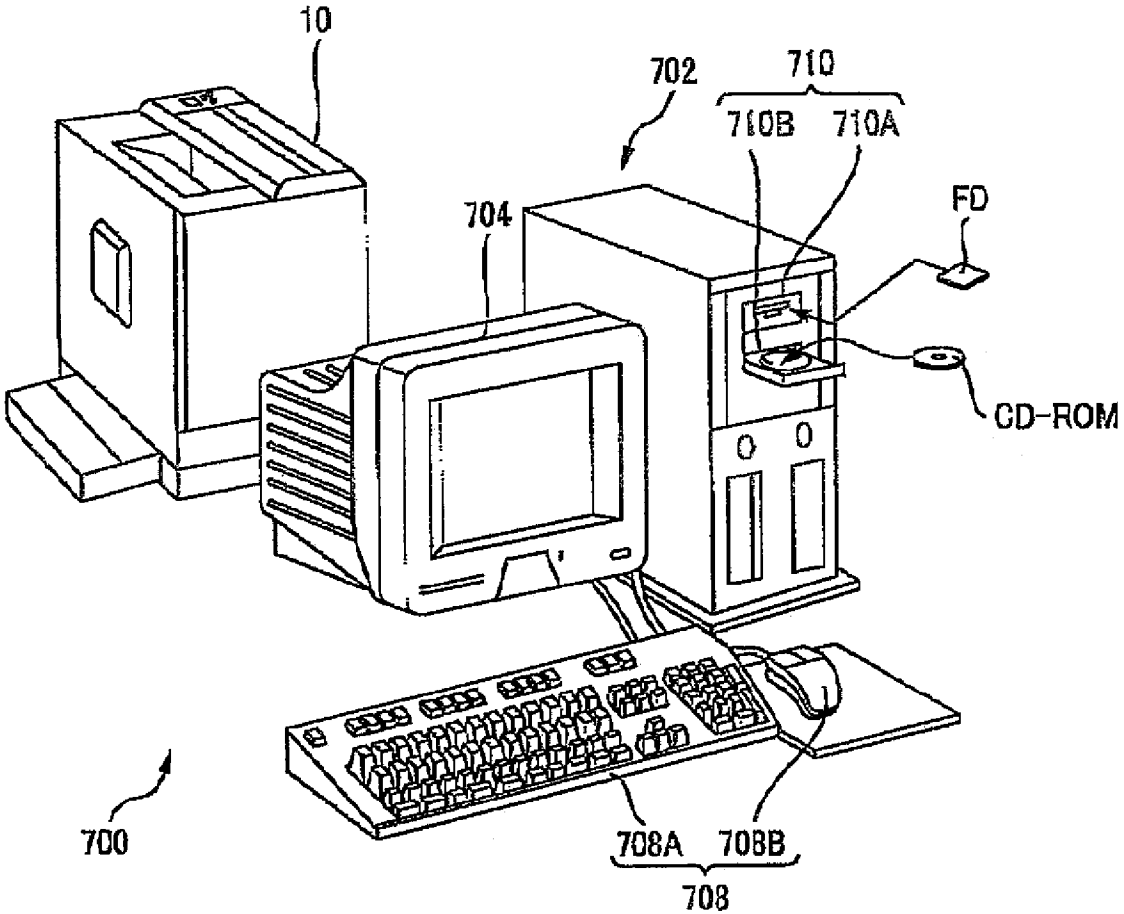
FIG. 1 is an explanatory diagram showing an external structure of an image forming system 700.

At least the following matters will be made clear by the description in the present specification and the accompanying drawings.

An image forming apparatus includes:

an image bearing body that is rotatable about a central axis thereof, and that bears a dot-like latent image, on a surface of the image bearing body, in each of a plurality of divided regions that are arranged in rows along a direction that intersects an axial direction of the central axis at a predetermined intersection angle; and a developer bearing roller that is rotatable in order to make visible, as a developer image, the dot-like latent images borne by the image bearing body, using a developer borne on a surface of the developer bearing roller, the developer bearing roller opposing the image bearing body such that an axial direction of the developer bearing roller is parallel to the axial direction of the image bearing body, and that includes a helical groove portion on the surface of the developer bearing roller, the helical groove portion being inclined at a predetermined inclination angle with respect to the axial direction of the developer bearing roller and being formed having a uniform pitch in the axial direction, wherein a value that is a tangent of the inclination angle divided by a ratio of a moving speed of the surface of the developer bearing roller to a moving speed of the surface of the image bearing body is different from a tangent of the intersection angle.

With such an image forming apparatus, it is possible to prevent the dot-like latent images from being made visible as a developer image by the developer which is borne on a same area of the groove portion (or, a same area other than the groove portion), each of the dot-like latent images being borne by each of a plurality of the divided regions which are arranged in rows along the intersection direction. Accordingly, this enables to prevent unevenness in density from becoming conspicuous.

In addition, the developer may be a first developer; a plurality of the divided regions may form divided-region groups; the divided-region groups may be a first divided-region group that bears dot-like latent images that are to be made visible as a developer image by the first developer, and a second divided-region group that bears dot-like latent images that are to be made visible as a developer image by a second developer whose color is different from a color of the first developer; and the value that is the tangent of the inclination angle divided by a ratio of the moving speed of the surface of the developer bearing roller to the moving speed of the surface of the image bearing body may be different from the tangent of the intersection angle of the first divided-region group and may be different from the tangent of the intersection angle of the second divided-region group.

In addition, the image forming apparatus may be able to form a color image by developers of four colors that include the first developer and the second developer; the divided-region groups may be four divided-region groups that each bear the dot-like latent images to be made visible as a developer image by the developer of each of the four colors; and the value that is the tangent of the inclination angle divided by a ratio of the moving speed of the surface of the developer bearing roller to the moving speed of the surface of the image bearing body may be different from a tangent of the intersection angle of each of the four divided-region groups.

In addition, the intersection angle of each of the four divided-region groups may be different from each other; the image forming apparatus may include four developer bearing rollers that bear the developer of each of the four colors; an inclination angle of the groove portion of each of the four developer bearing rollers may be the same as each other; and a value that is each a tangent of the inclination angle of the groove portion of each of the four developer bearing rollers, divided by a ratio of the moving speed of a surface of each developer bearing roller to the moving speed of the surface of the image bearing body may be different from the tangent of the intersection angle of any of the four divided-region groups.

In such a case, productivity in manufacturing of the developer bearing roller increases because the inclination angle of the groove portion of each of the four developer bearing rollers is the same as each other. On the other hand, it is possible to prevent unevenness in density from becoming conspicuous because the value is different from the tangent of the intersection angle of any of the four divided-region groups.

In addition, the developer may be a first developer; the developer bearing roller may be a first developer bearing roller; the image forming apparatus may include a second developer bearing roller that has the groove portion and that bears a second developer whose color is different from the color of the first developer; and the inclination angle of the groove portion of the second developer bearing roller may be different from the inclination angle of the groove portion of the first developer bearing roller.

In such a case, it is possible to effectively prevent unevenness in density from becoming conspicuous because it is possible to prevent unevenness in density caused by the groove portion of the first developer bearing roller from overlapping unevenness in density caused by the groove portion of the second developer bearing roller.

In addition, a plurality of the divided regions may form divided-region groups; the divided-region groups may be a first divided-region group that bears dot-like latent images that are to be made visible as a developer image by the first developer, and a second divided-region group that bears dot-like latent images that are to be made visible as a developer image by the second developer; and a value that is the tangent of the inclination angle of the groove portion of the second developer bearing roller divided by a ratio of a moving speed of a surface of the second developer bearing roller to a moving speed of the surface of the image bearing body may be different from the tangent of the intersection angle of the first divided-region group.

In addition, the image forming apparatus may be able to form a color image by developers of four colors that include the first developer and the second developer; the image forming apparatus may include four developer bearing rollers that include the first developer bearing roller and the second developer bearing roller and that bear the developer of each of the four colors; and the inclination angle of the groove portion of each of the four developer bearing rollers may be different from each other.

In such a case, it is possible to effectively prevent unevenness in density from becoming conspicuous because it is possible to prevent unevenness in density caused by the groove portion of each of the four developer bearing rollers from overlapping one another.

In addition, the image forming apparatus may be able to form a color image by developers of four colors that include the first developer and the second developer; the image forming apparatus may include four developer bearing rollers that include the first developer bearing roller and the second developer bearing roller and that bear the developers of each of the four colors; and the inclination angle of the groove portion of each of two developer bearing rollers among the four developer bearing rollers may be the same as each other.

For example, if the inclination angle of the groove portion of each of the four developer bearing rollers is the same in degree as each other, the developer bearing roller may not bear the developer appropriately because some of the developer bearing rollers have a larger inclination angle. In contrast, for example, if the inclination angles of the respective groove portions of the developer bearing rollers that have color in which unevenness in density is less likely to occur, are the same, it is possible to prevent any of developer bearing rollers from having a larger inclination angle of its groove portion.

In addition, the divided-region groups may be four divided-region groups that each bear the dot-like latent images to be made visible as a developer image by the developers of each of the four colors; the intersection angle of each of the four divided-region groups may be different in degree from each other; and a value that is each a tangent of the inclination angle of the groove portion of each of the four developer bearing rollers, divided by a ratio of a moving speed of a surface of each developer bearing roller to a moving speed of the surface of the image bearing body may be different from the tangent of the intersection angle of any of the four divided-region groups.

Also, the divided-region groups may be four divided-region region groups that each bear the dot-like latent images to be made visible as a developer image by the developers of each of the four colors; and the intersection angle of each of the four divided-region groups may be the same as each other.

In such a case, since the intersection angle of each of the four divided-region groups is the same, it is possible to control more simply than the case in which the intersection angle of each of the four divided-region groups is different from each other.

In addition, the developer bearing roller may include a cylindrical portion having the surface; and the cylindrical portion may be made of a single material.

In such a case, it is possible to easily manufacture the above-mentioned developer bearing roller.

In addition, the image forming apparatus further may include a layer-thickness restriction member that is for restricting a layer thickness of the developer borne on the developer bearing roller, by abutting against the developer bearing roller contiguously from one end section in the axial direction of the developer bearing roller to the other end section; and the layer-thickness restriction member may restrict the layer thickness by abutting against the developer bearing roller with a flat surface of the layer-thickness restriction member.

In such a case, it is possible to reduce, by restricting the layer thickness of the developer, unevenness in density caused by variation of the layer thickness.

An image forming apparatus includes:

a rotatable image bearing body that is for bearing dot-like latent images in divided regions that has been divided into lattices; and a rotatable developer bearing roller that includes a depressed and projecting section on a surface thereof, and that is for making visible, by bearing a developer on the surface, as a developer image the dot-like latent images that are borne by the image bearing body, wherein a positional relationship, in a circumferential direction of the image bearing body, between a center of each of the divided regions and an opposing portion, of the image bearing body, that opposes an axial-direction first portion of the depressed and projecting section when the axial-direction first portion is positioned at a position closest to the image bearing body, the axial-direction first portion being along an axial direction of the developer bearing roller, is different from a positional relationship, in the circumferential direction, between the center of each of the divided regions and an opposing portion, of the image bearing body, that opposes an axial-direction second portion of the depressed and projecting section when the axial-direction second portion is positioned at the position closest to the image bearing body with rotation of the developer bearing roller, the axial-direction second portion being along the axial direction of the developer bearing roller and being a same shape as the axial-direction first portion.

With such an image forming apparatus, a plurality of dot-like latent images which are lined in the circumferential direction of the image bearing body are respectively made visible as a developer image by the developer borne on respective portions, of the depressed/projecting section, that have a different cross-sectional shape. Accordingly, it is possible to reduce deterioration of image quality because an area in the developer image which is obtained by developing a plurality of the dot-like latent images lined in the circumferential direction is suppressed from becoming conspicuous as unevenness in density.

In addition, the depressed and projecting section may have a helical groove portion formed thereon as a depressed portion, the groove portion having an inclination with respect to the axial direction of the developer bearing roller and being formed having a uniform pitch in the axial direction; two types of the groove portions may be formed, an angle of the inclination of each of the types being different from each other; the two types of the groove portions may intersect each other and form lattices; and a projecting portion of the depressed and projecting section may be provided surrounded by the two types of the groove portions.

If the groove portion is formed having a uniform pitch in the axial direction, periodic unevenness in density is S likely to be caused by the depressed and projecting section of the developer bearing roller because the depressed portion and the projecting portion are provided regularly. Accordingly, in the above-mentioned case, providing the above-mentioned developer bearing roller makes the effect that unevenness in density is suppressed be achieved more advantageously unevenness in density.

In addition, the lattices that form the divided regions may be able to be formed at a plurality of types of pitches in a circumferential direction of a surface of the image bearing body; and a value that is a pitch of the groove portion, in the circumferential direction, divided by a ratio of a moving speed of the surface of the developer bearing roller to a moving speed of the surface of the image bearing body may be less than a longest pitch among a plurality of the types of the pitches of the lattices.

In such a case, every dot-like latent image includes a dot that is formed by a section, of the developer bearing roller, that includes the groove portion and a dot that is formed by a section that does not include the groove portion. Accordingly, it is possible to reduce the occurrence of unevenness in density caused by the groove portion, in a developed developer image.

An image forming apparatus includes:

an image bearing body that is for bearing dot-like latent images in divided regions that has been divided into lattices; and a developer bearing roller that includes a depressed and projecting section on a surface thereof, and that is for making visible, by bearing a developer on the surface, as a developer image the dot-like latent images that are borne by the image bearing body, wherein a positional relationship, in an axial direction of the image bearing body, between a center of each of the divided regions and an opposing portion, of the image bearing body, that is opposed to a circumferential-direction first portion of the depressed and projecting section, and the circumferential-direction first portion being along a circumferential direction of the developer bearing roller, is different from a positional relationship, in the axial direction of the image bearing body, between the center of each of the divided regions and an opposing portion, of the image bearing body, that is opposed to a circumferential-direction second portion of the depressed and projecting section, the circumferential-direction second portion being along the circumferential direction of the developer bearing roller and adjacent to the circumferential-direction first portion in an axial direction of the developer bearing roller and being a same shape as the circumferential-direction first portion.

With such an image forming apparatus, a plurality of dot-like latent images which are lined in the axial direction of the image bearing body are respectively made visible as a developer image by the developer borne on respective portions, of the depressed and projecting section, that have a different cross-sectional shape. Accordingly, it is possible to reduce deterioration of image quality because an area in the developer image which is obtained by developing a plurality of the dot-like latent images lined in the axial direction is prevented from becoming conspicuous as unevenness in density.

In addition, the lattices that form the divided regions may be able to be formed at a plurality of types of pitches in an axial direction of a surface of the image bearing body; and a pitch of the groove portion, in the axial direction, may be less than a longest pitch among a plurality of the types of the pitches of the lattices.

In such a case, every dot-like latent image includes a dot that is formed by a section, of the developer bearing roller, that includes the groove portion and a dot that is formed by a section that does not include the groove portion. Accordingly, it is possible to reduce the occurrence of unevenness in density caused by the groove portion, in a developed developer image.

EXAMPLE OF OVERALL CONFIGURATION OF IMAGE FORMING SYSTEM

Figure 2:
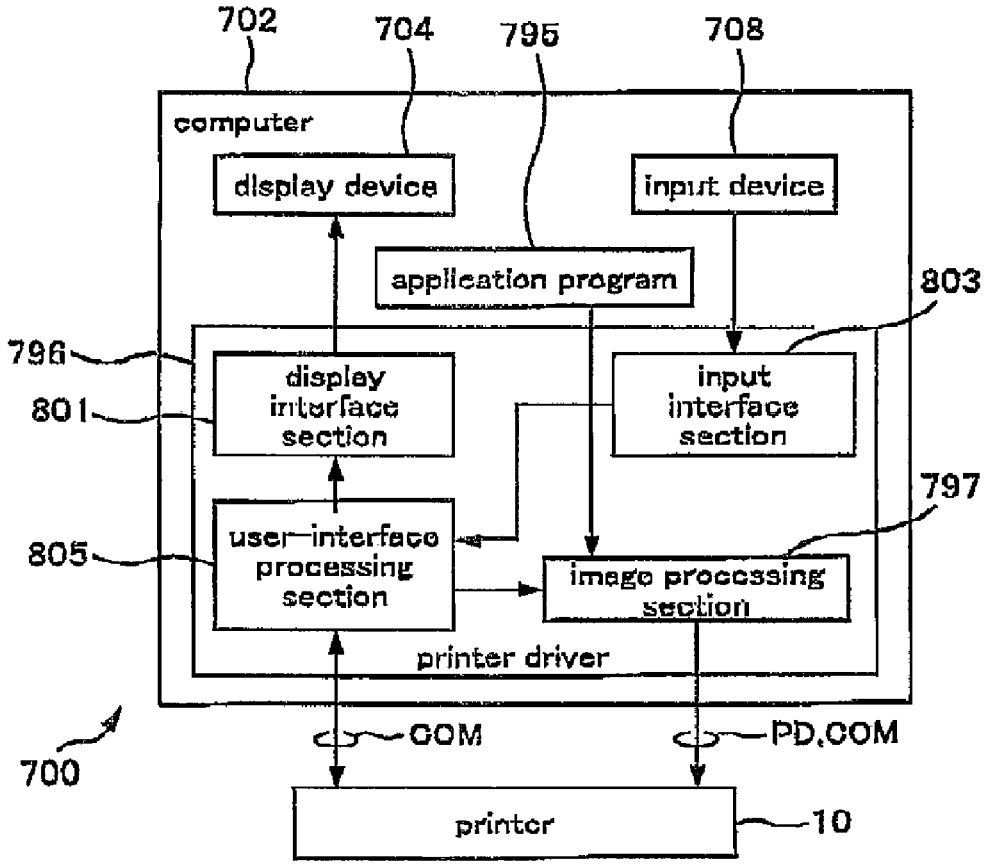
FIG. 2 is a block diagram showing a part of the structure of the image forming system 700 shown in FIG. 1.

An overview of an image forming system 700 is described with reference to FIGS. 1 and 2. FIG. 1 is an explanatory diagram showing an external structure of the image forming system 700. FIG. 2 is a block diagram showing a part of the structure of the image forming system 700 shown in FIG. 1. The image forming system 700 includes a laser beam printer (hereinafter also referred to as a printer) 10 as an image forming apparatus, and a computer 702 which can communicate with the printer 10.

The computer 702 includes a display device 704, for displaying information, such as CRT (Cathode Ray Tube), liquid crystal display device, plasma display, an input device 708 such as a keyboard 708A and a mouse 708B, a reading device 710 such as a FD (Flexible Drive) apparatus 710A, a CD-ROM drive device 710B, an MO (Magneto Optical) disk drive apparatus (not shown), a DVD (Digital Versatile Disk) apparatus (not shown), an internal memory such as a RAM (not shown), and an external memory such as a hard disk drive unit (not shown). In this embodiment, the computer 702 is accommodated in a mini-tower type enclosure, but this invention is not limited thereto.

Besides, the computer 702 includes an operating system, an application program 795 which operates under the operating system, and a printer driver 796 which serves as an example of a control program. The printer driver 796 includes an image processing section 797, a display interface section 801, an input interface section 803, and a user-interface processing section 805.

The application program 795 is a program, in the computer 702, which is for causing the printer 10 to perform image forming. Image data AD in the application program is sent to the printer driver 796 in response to an image-forming execution instruction from the application program 795.

The image processing section 797 has a function of receiving the image data AD which can be interpreted by the application program 795, converting it to image data PD which can be interpreted by the printer 10, and sending the converted image data PD to the printer 10 together with various control signals COM. In other words, the image processing section 797 of the printer driver 796 instructs the printer 10 to execute image forming after performing the above-mentioned image processing. In order to realize this function, the image processing section 797 performs, for example, resolution conversion, color conversion, and the like. Note that the image processing section 797 converts image data AD into image data PD according to halftone screens (to be described later) determined for respective colors.

The display interface section 801 has the function of displaying on the display device 704 a variety of user interface windows relating to image forming. The input interface section 803 has the function of receiving information which is input through the user interface window by a user using the input device 708.

The user-interface processing section 805 has the function of providing interface between the printer 10 and the display interface section 801 or between the printer 10 and the input interface section 803. For example, the user-interface processing section 805 receives the input information from the input interface section 803 and interprets the input information. Then, the user-interface processing section 805 sends various control signals COM to the printer 10 or the image processing section 797. Besides, the user-interface processing section 805 interprets various control signals COM received from the printer 10, and sends to the display interface section 801 information relating to display.

The printer driver 796 which is provided in the computer 702 is supplied in a form stored on a storage medium which can be read by a computer. As these storage media, various types of computer-readable media can be used, such as flexible disks, CD-ROMs, magneto-optic disks, IC cards, ROM cartridges, punch cards, printed material on which a code such as a barcode is printed, storage devices inside a computer (memories such as a RAM or ROM), and external storage devices. Also, such a computer program can be downloaded onto the computer 702 via the Internet.

Overview of Image Forming Apparatus

Figure 3:
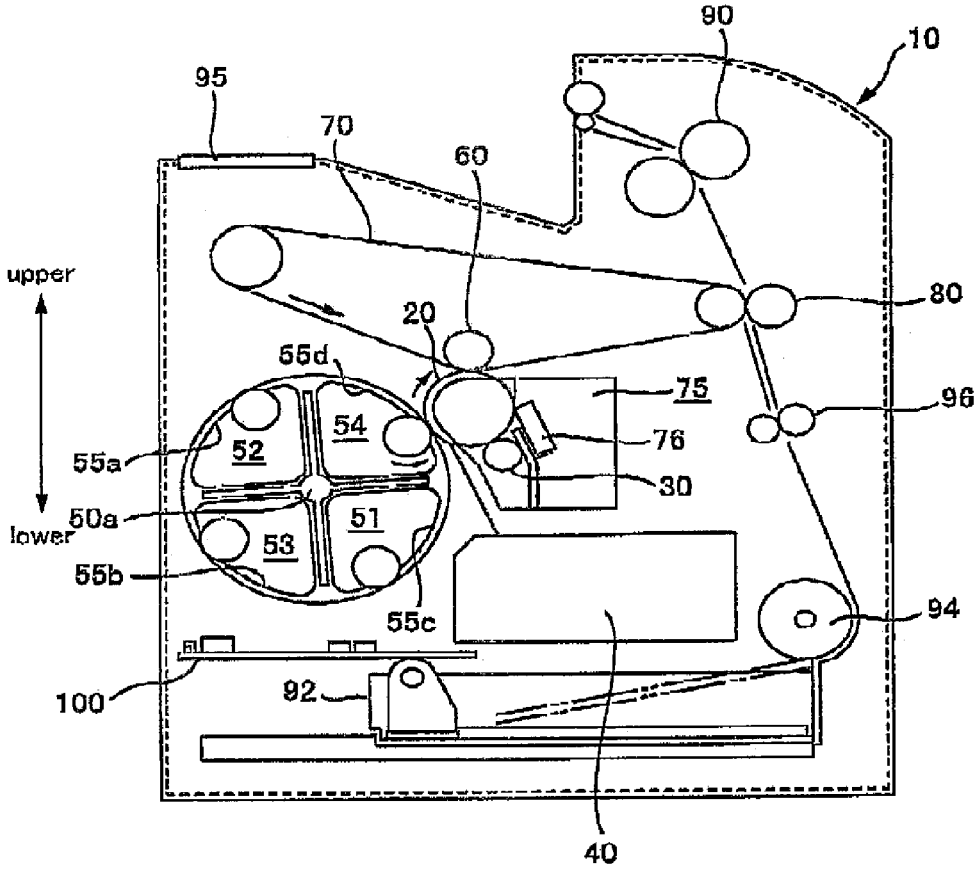
FIG. 3 is a diagram showing main components structuring a printer 10.

Next, an overview of the printer 10 is described with reference to FIG. 3. FIG. 3 is a diagram showing main components structuring the printer 10. Note that, in FIG. 3, the arrow indicates the up-and-down direction, and that a paper supply tray 92 is arranged in the lower section of the printer 10 and a fusing unit 90 is arranged in the upper section of the printer 10, for example.

CONFIGURATION EXAMPLE OF PRINTER 10

As shown in FIG. 3, the printer 10 according to this embodiment includes a charging unit 30, an exposing unit 40, a YMCK developing unit 50, a first transfer unit 60, an intermediate transfer body 70, and a cleaning unit 75, and they are provided along a rotating direction of a photoconductor 20 which serves as an example of an image bearing body. In addition, the printer 10 includes a second transfer unit 80, the fusing unit 90, a displaying unit 95 which serves as means for making notifications to users and is constructed of a liquid-crystal panel, and a control unit 1 which controls these units, etc. and manages the operation as a printer.

The photoconductor 20 has a cylindrical conductive base and a photoconductive layer formed on an outer peripheral surface of the base, and it is rotatable about its central axis. In this embodiment, the photoconductor 20 rotates clockwise, as indicated by the arrow in FIG. 3.

The charging unit 30 is a device for charging the photoconductor 20. The exposing unit 40 is for forming dot-like like latent images on the photoconductor 20 by emitting laser beam successively onto the photoconductor 20. Note that, details of the exposing unit 40 will be described later.

The YMCK developing unit 50 is a device for developing a latent image formed on the photoconductor 20, using the toner which serves as an example of developer contained in a developing device, that is, using black (K) toner contained in a black developing device 51, magenta (M) toner contained in a magenta developing device 52, cyan (C) toner contained in a cyan developing device 53, and yellow (Y) toner contained in a yellow developing device 54.

The YMCK developing unit 50 enables to move the positions of the four developing devices 51, 52, 53, 54 by its rotation with the four developing device 51, 52, 53, 54 being attached thereto. More specifically, the YMCK developing unit 50 holds the four developing devices 51, 52, 53, 54 with four holding sections 55*a*, 55*b*, 55*c*, 55*d*, and the above-mentioned four developing devices 51, 52, 53, 54 are rotatable about a central axis 50*a* while keeping their respective positions relatively. Every time an image forming process for one page is finished, the four developing devices 51, 52, 53, 54 are selectively opposed to the photoconductor 20, and successively develop the latent image formed on the photoconductor 20, using toner T which is contained in each of the developing devices 51, 52, 53, 54. Note that each of the above-mentioned four developing devices 51, 52, 53, 54 is detachable from the holding section of the YMCK developing unit 50. Details of each developing device will be described later.

The first transfer unit 60 is a device for transferring a single-color toner image formed on the photoconductor 20, onto the intermediate transfer body 70. When toners of four colors are successively transferred in a superposed manner, a full-color toner image is formed on the intermediate transfer body 70. The intermediate transfer body 70 is an laminated endless belt which is made by providing a metal layer (aluminum, tin, etc.) by vapor deposition on the surface of a PET film and further applying semiconducting coating on the outer layer thereof, and is driven and rotated at the approximately the same circumferential speed as the photoconductor 20. The second transfer unit 80 is a device for transferring the single-color toner image or the full-color toner image formed on the intermediate transfer body 70, onto a medium such as paper, film, and cloth.

The fusing unit 90 is a device for fusing, onto the medium, the single-color toner image or the full-color toner image which has been transferred onto the medium, to make the image into a permanent image. The cleaning unit 75 is provided between the first transfer unit 60 and the charging unit 30, has a cleaning blade 76 which is made of rubber and made to abut against the surface of the photoconductor 20. The cleaning unit 75 is a device for removing toner T which remains on the photoconductor 20, by scraping it off with the cleaning blade 76 after the toner image has been transferred onto the intermediate transfer body 70 by the first transfer unit 60.

Figure 4:
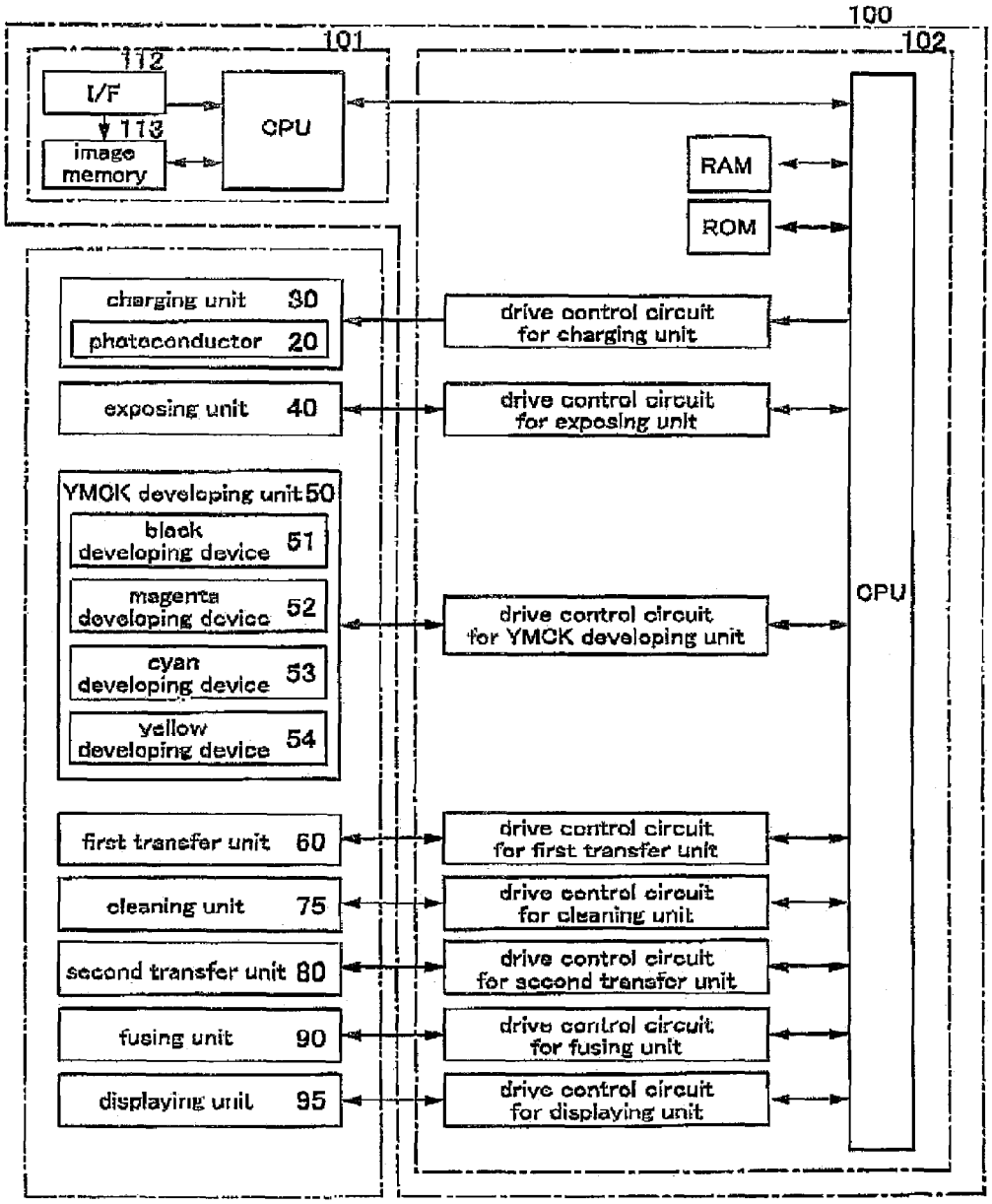
FIG. 4 is a block diagram showing a control unit of the printer 10 shown in FIG. 3.

The control unit 1 is configured by a main controller 101 and a unit controller 102, as shown in FIG. 4. Image signals and control signals are input to the main controller 101, and according to instructions based on these image signals and control signals, the unit controller 102 controls each of the above-mentioned units, etc. to form an image.

EXAMPLE OF OPERATION OF PRINTER 10

Next, operations of the printer 10 having the above-mentioned configuration are described. When the image signals and the control signals are input from the not-shown host computer to the main controller 101 of the printer 10 through an interface (I/F) 112, the photoconductor 20 and the intermediate transfer body 70 rotate under the control of the unit controller 102 according to the instructions from the main controller 101. While rotating, the photoconductor 20 is successively charged by the charging unit 30 at a charging position.

With the rotation of the photoconductor 20, the charged area of the photoconductor 20 reaches an exposing position. A latent image which corresponds to image information for a first color, for example yellow Y, is formed in the area by the exposing unit 40. Further, in the YMCK developing unit 50, a yellow developing device 54 containing yellow (Y) toner is located at a developing position in opposition to the photoconductor 20. With the rotation of the photoconductor 20, the latent image formed on the photoconductor 20 reaches its developing position, and is developed by the yellow developing device 54 using yellow toner. Thereby, a yellow toner image is formed on the photoconductor 20. With the rotation of the photoconductor 20, the yellow toner image formed on the photoconductor 20 reaches a first transfer position, and is transferred onto the intermediate transfer body 70 by the first transfer unit 60. At this time, a first transfer voltage, which is in an opposite polarity to the polarity to which the toner T is charged, is applied to the first transfer unit 60. Note that, during this time, the photoconductor 20 and the intermediate transfer body 70 are placed in contact with each other and the second transfer unit 80 is separated from the intermediate transfer body 70.

By performing successively the above-mentioned process for each of the developing devices associating with a second color, a third color, and a fourth color respectively, toner images in four colors associated with the respective image signals are transferred onto the intermediate transfer body 70 in a superposed manner. Thereby, a full-color toner image is formed on the intermediate transfer body 70.

With the rotation of the intermediate transfer body 70, the full-color toner image formed onto the intermediate transfer body 70 reaches a second transfer position, and is transferred onto the medium by the second transfer unit 80. Note that the medium is carried from the paper supply tray 92 to the second transfer unit 80 through a paper supply roller 94 and resisting rollers 96. During the transfer operation, a second transfer voltage is applied to the second transfer unit 80, the second transfer unit 80 being pressed against the intermediate transfer body 70.

The full-color toner image transferred onto the medium is heated and pressurized by the fusing unit 90 and is fused to the medium. On the other hand, after the photoconductor 20 has passed the first transfer position, toner T adhering to the surface thereof is scraped off by the cleaning blade 76 which is supported by the cleaning unit 75, and the photoconductor 20 is prepared for charging which is for formation of a next latent image. The scraped toner T is collected by a residual toner collector included in the cleaning unit 75.

Overview of Control Unit

Next, a configuration of the control unit 1 is described with reference to FIG. 4. FIG. 4 is a block diagram showing a control unit of the printer 10 shown in FIG.3.

The main controller 101 of the control unit 100 is electrically connected to the host computer through the interface 112 and is furnished with an image memory 113 for storing the image signals which have been input from the host computer. The unit controller 102 is electrically connected to the units in the body of the apparatus (for example, the charging unit 30, the exposing unit 40, the YMCK developing unit 50, the first transfer unit 60, the cleaning unit 75, the second transfer unit 80, the fusing unit 90, and the displaying unit 95), and it detects the state of the units by receiving signals from sensors provided in those units and controls them based on the signals which are input from the main controller 101.

Overview of Exposing Unit

Figure 5:
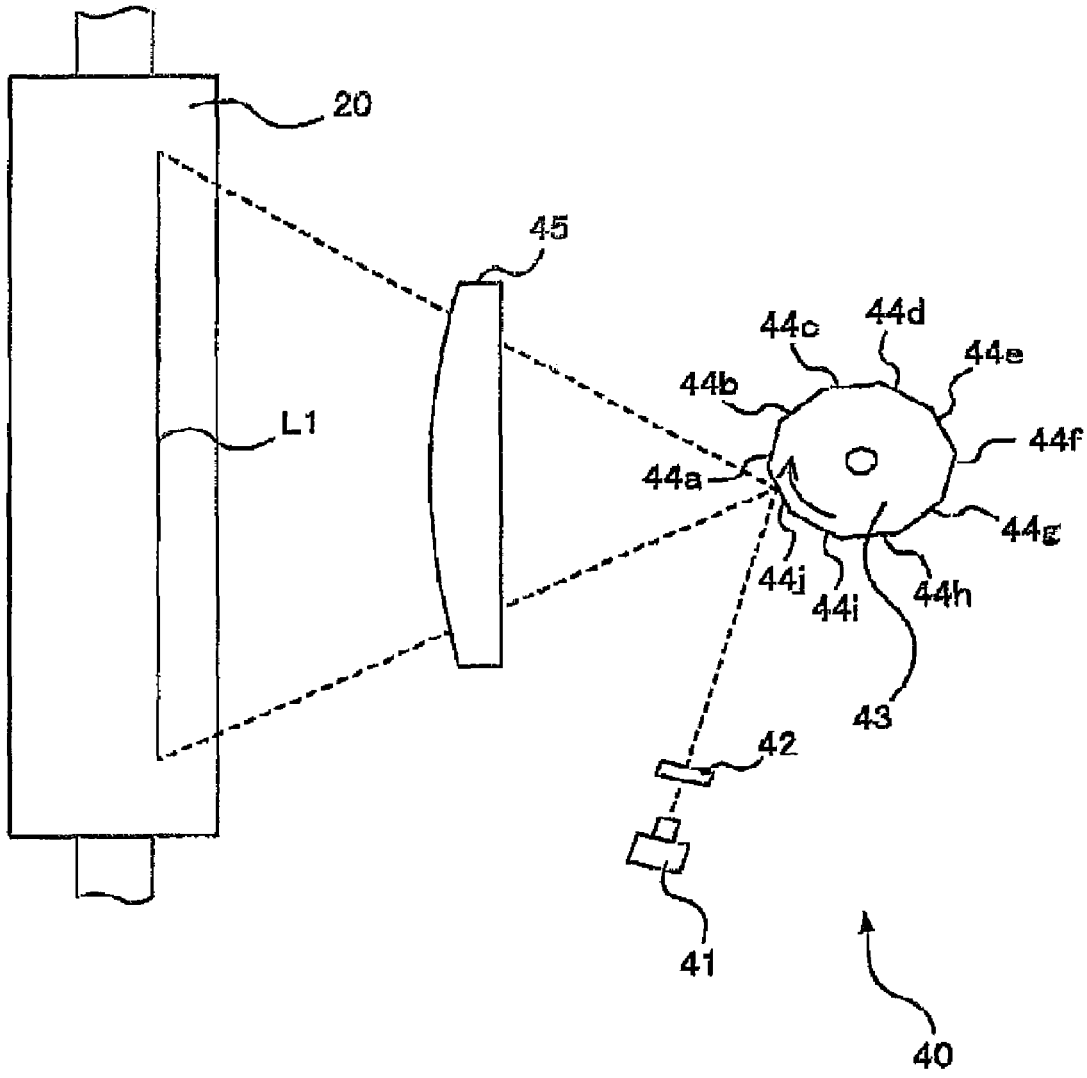
FIG. 5 is a schematic diagram showing a configuration of an exposing unit 40.

Next, an overview of the exposing unit 40 is described with reference to FIG. 5. FIG. 3 is a schematic diagram showing a configuration of the exposing unit 40. The exposing unit 40 has a light source 41, a collimator lens 42, a polygon mirror 43 which serves as an example of a rotating element, an f-θ lens 45, and the like.

The light source 41 is for emitting laser beams. The collimator lens 42 is a lens which is for condensing and paralleling the laser beam emitted by the light source 41. The polygon mirror 43 is a rotate polygon mirror and is for reflecting towards the photoconductor 20 the laser beam which is condensed and paralleled by the collimator lens 42. The polygon mirror 43 is rotatable about its rotating shaft in a clockwise direction in FIG. 5. Besides, the polygon mirror 43 is furnished, on its outer peripheral section, with a plurality of mirror faces 44 which serves as an example of a reflection plane which reflects the laser beam. Note that the polygon mirror 43 is a decahedron and includes ten mirror faces (mirror faces 44*a*, 44*b*, etc. shown in FIG. 5). These ten mirror faces 44 are provided such that they are parallel to the rotating shaft of the polygon mirror 43. Note that any of the ten mirror faces 44 (for example, the mirror face 44*a*) serves as a first reflection plane. The f-θ lens 45 is a lens which is for causing the laser beam which is reflected by the mirror faces 44, to scan the surface of the photoconductor 20 at constant speed.

The exposing unit 40 having the above-mentioned configuration causes the light source 41 to emit the laser beam, according to image signals that have been input from a not-shown host computer such as a personal computer or a word processor. The laser beam emitted by the light source 41 is condensed and paralleled by the collimator lens 42, and thereafter, is reflected by the mirror faces 44 of the polygon mirror 43 which is rotating. Then, the laser beam reflected by the mirror faces 44 passes through the f-θ lens 45 and scans the surface of the charged photoconductor 20 at constant speed. Accordingly, dot-like latent images are formed arranged in the axial direction of the photoconductor 20. Note that FIG. 3 shows dot-like latent images which are formed by the laser beam reflected by the mirror face 44*a*, which is one of ten mirror faces (dot-like latent images indicated by straight line L1 ).

Overview of Developing Device

Figure 6:
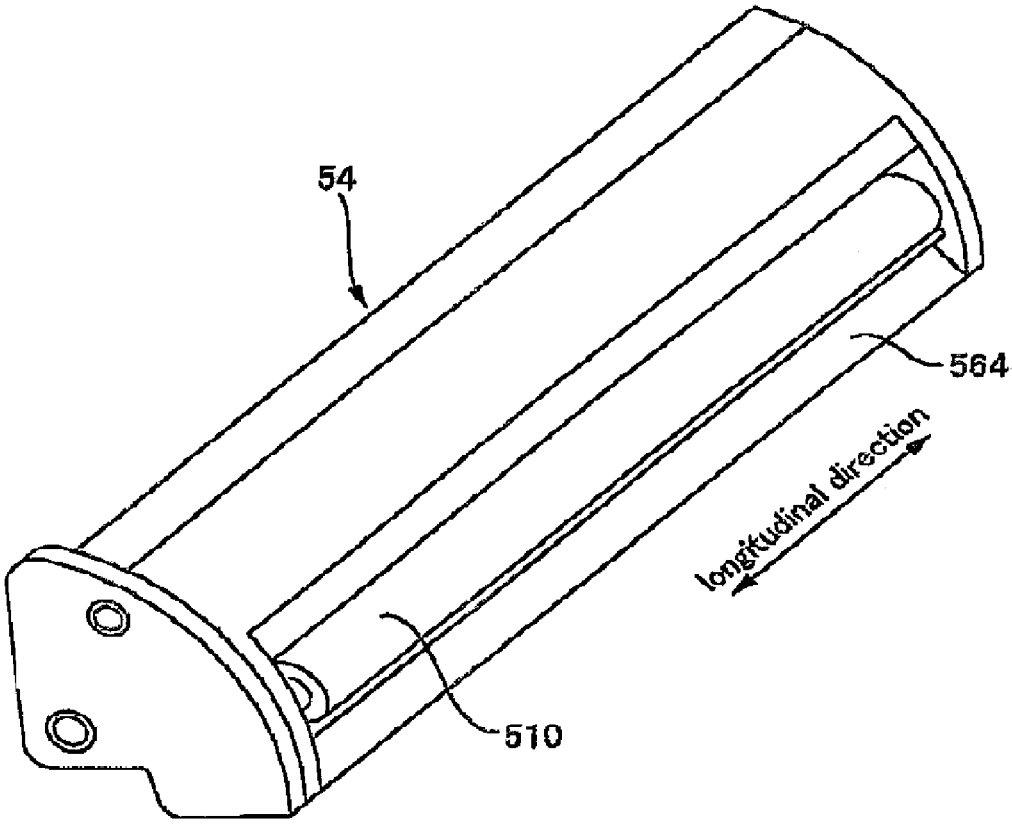
FIG. 6 is a diagram conceptually showing a developing device.
Figure 7:
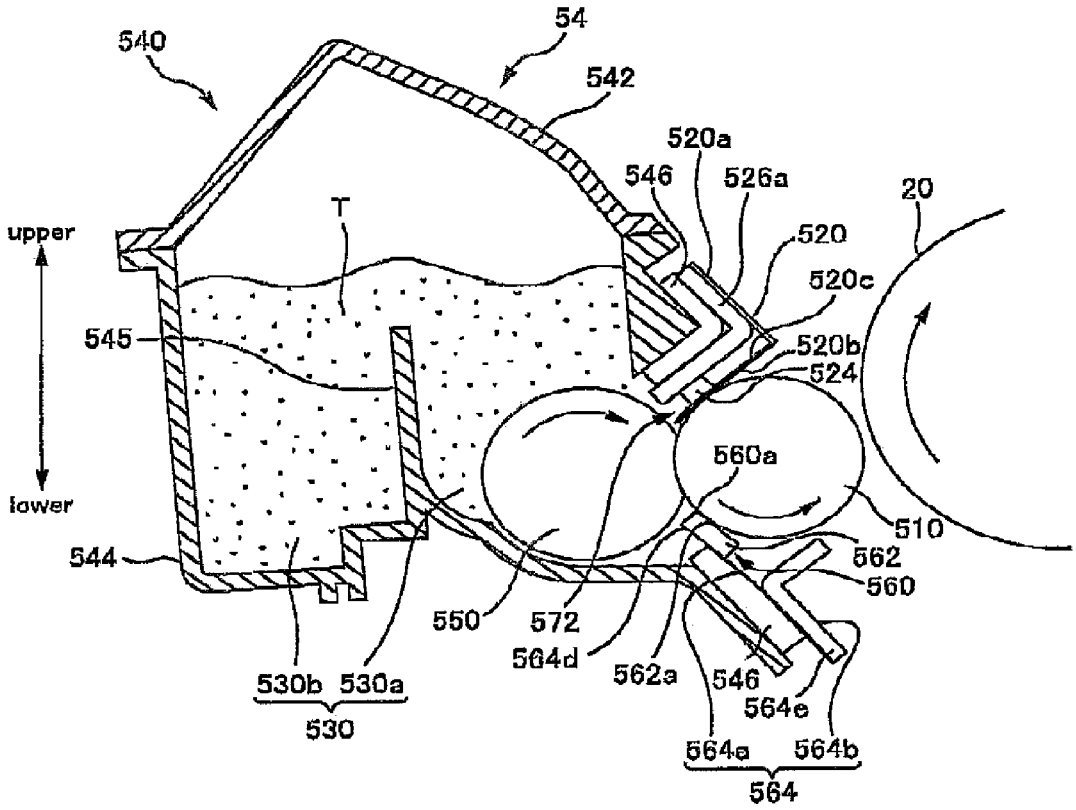
FIG. 7 is a cross-sectional view showing main components of a developing device.

Next, examples of configuration and operation of the developing device are described with reference to FIGS. 6 and 7. FIG. 6 is a diagram conceptually showing the developing device. FIG. 7 is a cross-sectional view showing main components of the developing device. Note that the cross-sectional view shown in FIG. 7 shows a cross-section of the developing device when cut by a plane perpendicular to the longitudinal direction shown in FIG. 6. In FIG. 7, in the same way as in FIG. 6, the up-and-down direction is indicated by an arrow, and a central axis of a developing roller 510 is located below a central axis of the photoconductor 20, for example. Further, in FIG. 7, the yellow developing device 54 is shown being located at the developing position in opposition to the photoconductor 20.

The YMCK developing unit 50 is furnished with the black developing device 51 containing black (K) toner, the magenta developing device 52 containing magenta (M) toner, the cyan developing device 53 containing cyan (C) toner, and the yellow developing device 54 containing yellow (Y) toner. However, only the yellow developing device 54 is described below because the configuration of the developing devices is substantially same.

CONFIGURATION EXAMPLE OF DEVELOPING DEVICE

The yellow developing device 54 includes the developing roller 510 which serves as an example of a developer bearing roller, an upper seal 520, a toner containing body 530, a housing 540, a toner supply roller 550, a restriction blade 560 which serves as an example of a layer-thickness restriction member, and the like.

Using the toner borne on a surface of the developing roller 510, the developing roller 510 makes visible as a toner image dot-like latent images borne on the photoconductor 20, while the developing roller 510 is opposed to the photoconductor 20 such that the axial direction of the roller 510 is parallel to the axial direction of the photoconductor 20. The developing roller 510 is a member made of aluminum alloy, iron alloy and the like. Besides, the developing roller 510 includes a projecting portion 519 and a depressed portion 518 on the surface thereof. The form of the surface of the developing roller 510 will be described in greater detail later.

Further, the developing roller 510 is supported at both end portions, in a longitudinal direction, of the developing device (in axial direction of the developing roller 510), as shown in FIG. 6. And, the developing roller 510 is rotatable about the central axis. As shown in FIG. 7, the developing roller 510 rotates in a direction (counterclockwise in FIG. 7) opposite the rotating direction of the photoconductor 20 (clockwise in FIG. 7). Its central axis is located below the central axis of the photoconductor 20. Note that a moving speed (linear velocity) of the surface of the developing roller 510 is different from a moving speed (linear velocity) of the surface of the photoconductor 20.

Further, when the yellow developing device 54 is opposed to the photoconductor 20, a gap exists between the developing roller 510 and the photoconductor 20. More specifically, the yellow developing device 54 develops, without contacting, the latent image formed on the photoconductor 20. Note that, when the latent image formed on the photoconductor 20 is developed, an alternating electric field is generated between the developing roller 510 and the photoconductor 20.

The housing 540 is manufactured by welding together a plurality of housing sections made of resin that are integrally-molded, namely, a housing upper section 542 and a housing lower section 544. The toner containing body 530 for containing particulate toner T is formed in the housing 540. The toner containing body 530 is separated into two toner containers, that is, a first toner container 530*a* and a second toner container 530*b*, by a partitioning wall 545 which protrudes inwardly from an inner wall (to the up-and-down direction in FIG. 7) and is for separating toner T.

The first toner container 530*a* and the second toner container 530*b* are connected to each other at their respective upper sections. In the state shown in FIG. 7, the partitioning wall 545 restricts movement of the toner T. However, when the YMCK developing unit 50 rotates, the toner contained in the first toner container 530*a* and in the second toner container 530*b* is once gathered in the connected section on the upper side in the developing position. When returning to a state shown in FIG. 7, the toner is mixed and is moved back to the first toner container 530*a* and the second toner container 530*b* . In other words, by the rotation of the YMCK developing unit 50, the toner T in the developing device is stirred appropriately.

Therefore, in this embodiment, the toner containing body 530 is not furnished with a stirring member, but it is possible to provide a stirring member for stirring the toner T contained in the toner containing body 530. Further, as shown in FIG. 7, the housing 540 (that is the first toner container 530*a* ) includes an opening 572 in the lower section thereof, and the developing roller 510 is provided facing the opening 572.

The toner supply roller 550 is provided on the above-mentioned first toner container 530*a* , and supplies to the developing roller 510 the toner T contained in the first toner container 530*a* , as well as scrapes off, from the developing roller 510, the toner T which remains on the developing roller 510 after development. The toner supply roller 550 is made of polyurethane foam, etc., and abuts against the developing roller 510 while being deformed elastically. The toner supply roller 550 is located in the lower section of the first toner container 530*a* , and the toner T contained in the first toner container 530*a* is supplied by the toner supply roller 550 to the developing roller 510 at a lower section of the first toner container 530*a* . The toner supply roller 550 is rotatable about its central axis, and the central axis is located below the central axis of rotation of the developing roller 510. Further, the toner supply roller 550 rotates in a direction (clockwise in FIG. 7) opposite a rotating direction of the developing roller 510 (counterclockwise in FIG. 7).

The upper seal 520 abuts against the developing roller 510 along the axial direction of the roller, allows to move, into the housing 540, the toner T which remains on the developing roller 510 after passing through the developing position, and restricts movement of the toner T in the housing 540 towards the outside of the housing 540. The upper seal 520 is a seal made of polyethylene film, etc. The upper seal 520 is supported by an upper-seal supporting section 526*a* of a holder 526 to be described later, and is provided such that its longitudinal direction is along the axial direction of the developing roller 510. An abutting position at which the upper seal 520 abuts against the developing roller 510 is located above the central axis of the developing roller 510.

Further, an upper seal urging member 524, made of an elastic body such as Moltoprene, is provided in a compressed state between the upper seal supporting section 526*a* and an opposite surface of the upper seal 520 (the surface is also referred to as an opposite surface) which is located opposite an abutting surface 530*b* which abuts against the developing roller 510. The upper seal urging member 524 urges, with its urging force, the upper seal 520 towards the developing roller 510, so that it presses the upper seal 520 to touch the developing roller 510.

The restriction blade 560 abuts, with an abutting section 562*a* thereof, against the developing roller 510 contiguously from one of the end sections in the axial direction of the developing roller 510 to the other of the end sections, so that the restriction blade 560 restricts a layer thickness of the toner T borne by the developing roller 510. Also, the restriction blade 560 charges electrically the toner T which is borne by the developing roller 510. The restriction blade 560 includes a rubber section 562 and a rubber supporting section 564, as shown in FIG. 7.

The rubber section 562 is made of silicon rubber, urethane rubber, etc., and abuts against the developing roller 510. The rubber supporting section 564 consists of a thin plate 564*a* and a thin plate supporting section 564*b*, and supports the rubber section 562 by its lateral-direction first end section 564*d* (i.e., an end section located on the side of the thin plate 564*a* ). The thin plate 564*a* is made of phosphor bronze, stainless steel, etc. and has a spring-like characteristic. The thin plate 564*a* supports the rubber section 562, and presses, with its urging force, the rubber section 562 to touch the developing roller 510. The thin plate supporting section 564*b* is a metal plate which is located on a lateral-direction second end section 564*e* of the rubber supporting section 564. The thin plate supporting section 564*b* is attached to the thin plate 564*a* while supporting an opposite end, of the thin plate 564*a* , which is located opposite an end which is supporting the rubber section 562.

An end, of the restriction blade 560, which is located opposite an end close to the thin plate supporting section 564*b*, that is, an edge 560*a* is not in contact with the developing roller 510, but a section located at a predetermined distance from the edge 560*a* (i.e., the abutting section 562*a*) is in contact with the developing roller 510 over a certain width. In other words, the restriction blade 560 does not abut at the edge thereof, but does abut in surface-to-surface contact, against the developing roller 510, and restricts the layer thickness by abutting against the developing roller 510 with a flat surface of the restriction blade 560 (specifically, a flat surface of the rubber section 562). Besides, the restriction blade 560 is arranged such that its edge 560*a* points towards the upstream side of the rotating direction of the developing roller 510, and makes a so-called counter-abutment with respect to the developing roller 510. Note that an abutting position at which the restriction blade 560 abuts against the developing roller 510 is located lower than the central axis of the developing roller 510, and lower than the central axis of the toner supply roller 550. Further, the restriction blade 560 serves to prevent spillage of the toner T from the toner containing body 530, by abutting against the developing roller 510 along the axial direction of the roller 510.

EXAMPLE OF OPERATION OF DEVELOPING DEVICE

In the yellow developing device 54 constructed as mentioned above, the toner supply roller 550 supplies to the developing roller 510 toner T contained in the toner containing body 530. With the rotation of the developing roller 510, the toner T supplied to the developing roller 510 reaches the abutting position of the restriction blade 560; on passing through the abutting position, the layer thickness is restricted and the toner T is charged electrically. With further rotation of the developing roller 510, the charged toner T which is on the developing roller 510 and whose layer thickness is restricted reaches the developing position opposing the photoconductor 20, and is used at the developing position for developing of a latent image formed on the photoconductor 20 under an alternating electric field. The toner T on the developing roller 510 which has passed through the developing position with further rotation of the developing roller 510 passes through the upper seal 520, and the toner T is collected into the developing device without being scraped off by the upper seal 520. Furthermore, toner T still remaining on the developing roller 510 can be scraped off by the toner supply roller 550.

Regarding Form of Surface of Developing Roller 510 and Method of Manufacturing Thereof

Regarding Form of Surface of Developing Roller 510

Figure 8:
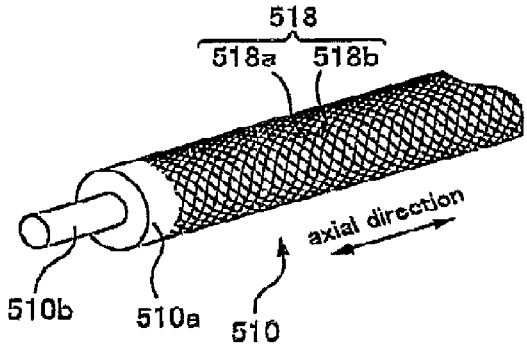
FIG. 8 is a perspective view of a schematic diagram showing a developing roller 510, and shows depressed portions 518.
Figure 9:
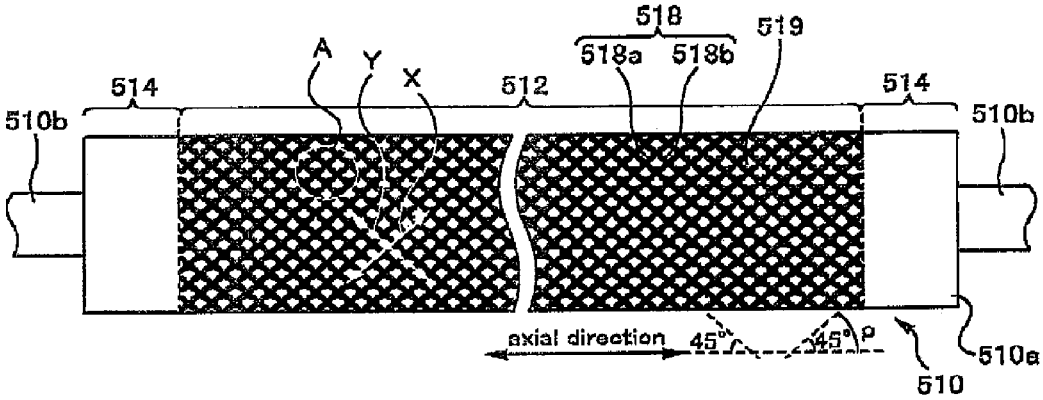
FIG. 9 is a front view of a schematic diagram showing the developing roller 510.
Figure 10:
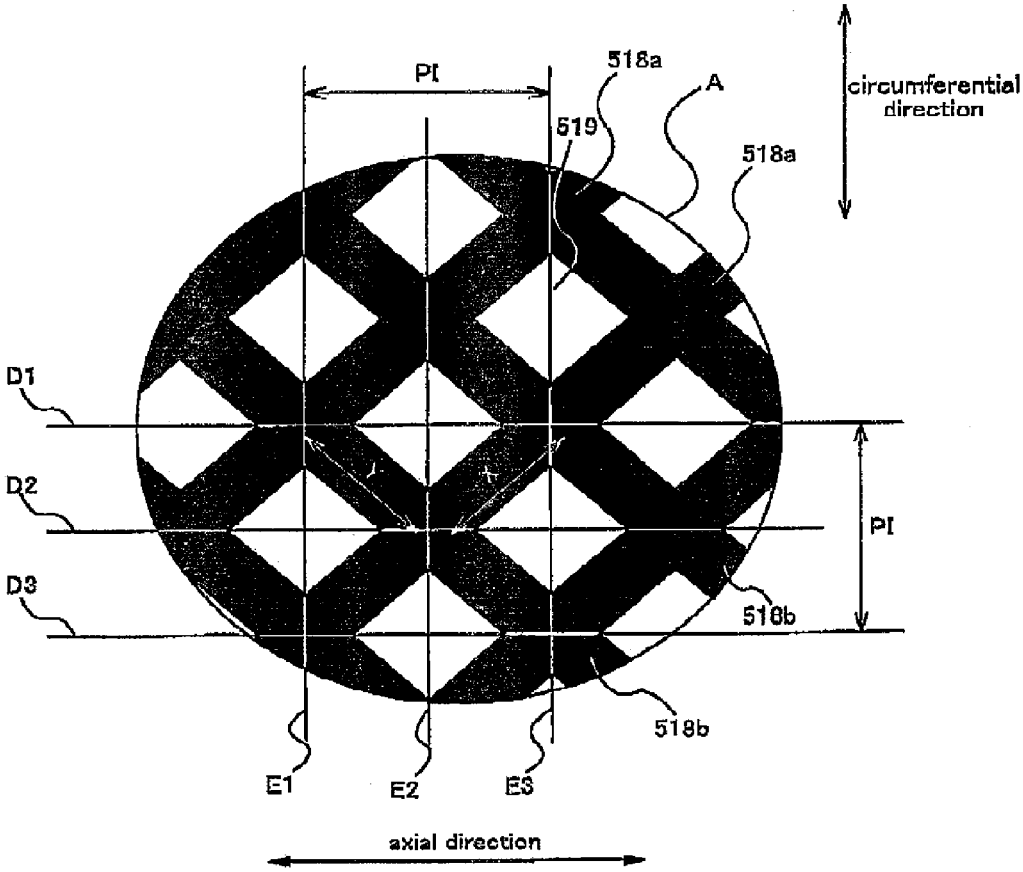
FIG. 10 is a schematic diagram showing a surface of the developing roller 510 and is a magnified diagram of a portion A shown in FIG. 9.
Figure 11:
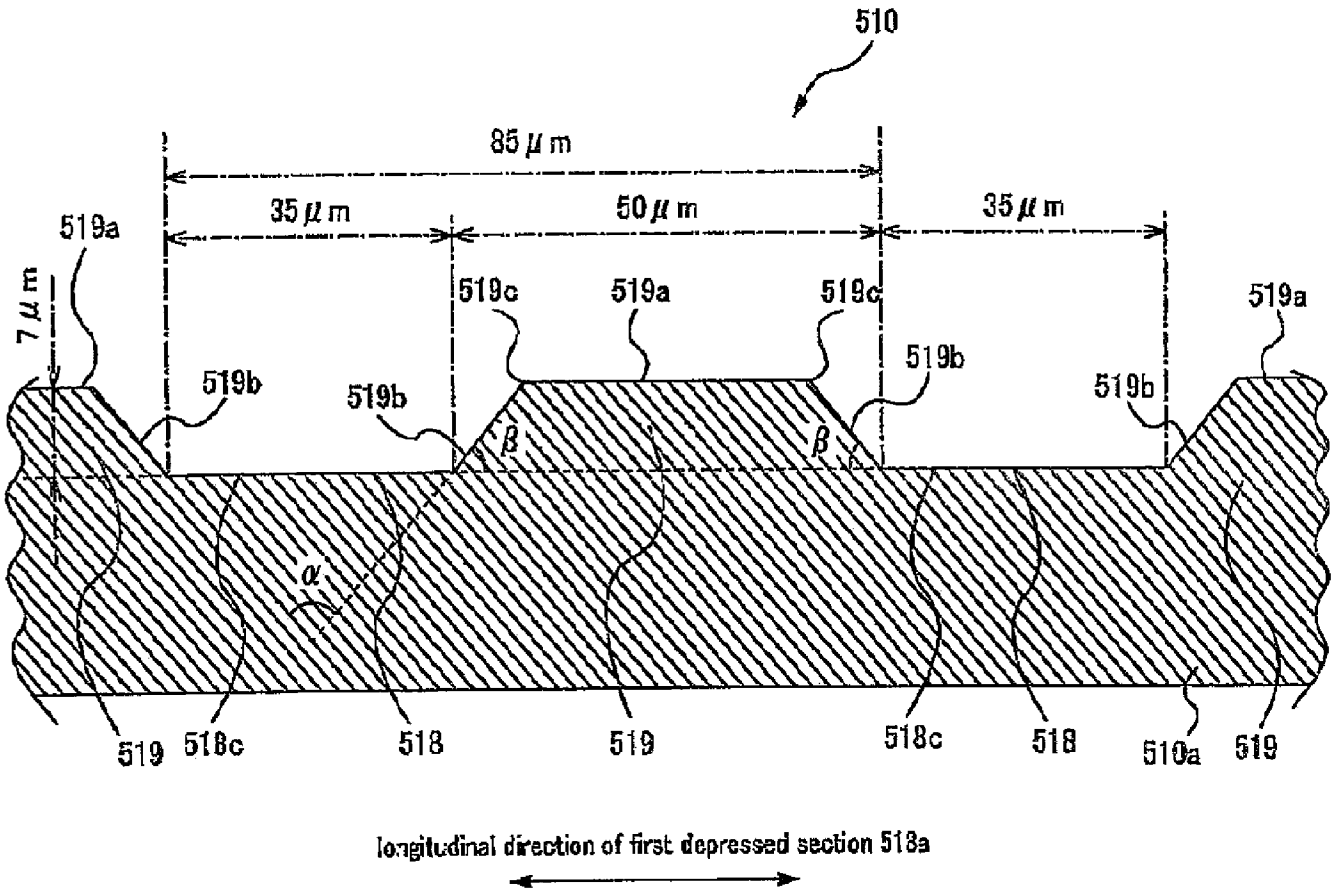
FIG. 11 is a schematic diagram showing a cross-sectional shape of a projecting portion 519 and a depressed portion 518.

First, a form of the surface of the developing roller 510 of the yellow developing device 54 is described with reference to FIGS. 8 through 11. FIG. 8 is a perspective view of a schematic diagram showing the developing roller 510, and a view illustrating the depressed portion 518. FIG. 9 is a front view of a schematic diagram showing the developing roller 510. FIG. 10 is a schematic diagram showing the surface of the developing roller 510, and is a magnified diagram of a portion A shown in FIG. 9. FIG. 11 is a schematic diagram showing a cross-sectional shape of the projecting portion 519 and the depressed portion 518.

The axial direction of the developing roller 510 in FIGS. 8 through 10, a circumferential direction of the developing roller 510 in FIG. 10, and a longitudinal direction of a first depressed portion 518*a* in FIG. 11 are indicated by arrows respectively. Besides, in FIGS. 8 through 11, a scale on which the projecting portion 519 and the like are illustrated is different from the actual scale for the purpose of facilitating the understanding of the drawings. Further, in FIGS. 9 and 10, a direction indicated by an arrow labeled by a symbol "X" shows a longitudinal direction of the first depressed portion 518*a* , and a direction indicated by an arrow labeled by a symbol "Y " shows a longitudinal direction of a second depressed portion 518*b*. FIG. 11 shows a cross-section taken along the longitudinal direction of the first depressed portion 518*a* , which is indicated by symbol Y in FIG. 9. Note that, regarding cross-sections of the projecting portion 519 and the depressed portion 518 which are taken along the longitudinal direction of the second depressed portion 518*b* (indicated by symbol X in FIG. 9), cross-sectional shapes of the projecting portion 519 and the depressed portion 518 are the same as the cross-sectional shapes of the projecting portion 519 and the depressed portion 518 shown in FIG. 11.

The developing roller 510 includes a cylindrical portion 510*a* and a shaft portion 510*b*, as shown in FIGS. 8, 9, etc. The cylindrical portion 510*a* bears on a surface thereof toner which is particulate. The cylindrical portion 510*a* is made of a single material such as aluminum alloy, and an indentation-processed section 512 and a non-indentation-processed section 514, which serve as an example of depressed and projected section, are formed on the surface thereof as shown in FIG. 9. The shaft portion 510*b* is located at both end portions in the axial direction of the developing roller 510 and is supported by the housing 540 through a not shown bearing.

The indentation-processed section 512 is a section located on the central section in the axial direction of the developing roller 510, and the surface thereof is provided by an indentation process in order to appropriately bear the toner T (the projecting portion 519 and the depressed portion 518 of the indentation-processed section 512 both function as a toner bearing section for bearing the toner T). In this embodiment, so-called rolling (rolling will be described in greater details later in the section regarding a method of manufacturing the developing roller 510) is used as the above-mentioned indentation process, and the depressed portion 518 and the projecting portion 519 are formed by the above-mentioned rolling on a surface of the indentation-processed section 512. More specifically, grooves are formed by rolling on the surface of the indentation-processed section 512, and therefore, the indentation-processed section 512 has the depressed portion 518 and the projecting portion 519.

As shown in FIG. 8, the depressed portion 518 is a helical groove portion which has a predetermined inclination angle p with respect to the axial direction and the circumferential direction of the developing roller 510 and is formed at a uniform pitch in the axial direction. Two types of the depressed portions 518 are formed, and their respective inclination angle with respect to the axial direction and the circumferential direction of the developing roller 510 are different (specifically, the first depressed portion 518*a* and the second depressed portion 518*b* are formed such that they intersect to form lattices).

More specifically, the first depressed portion 518*a* is formed helically such that it and the axial direction of the developing roller 510 make an angle of 45° counterclockwise, and the second depressed portion 518*b* is formed helically such that it and the axial direction of the developing roller 510 make an angle of 45° clockwise. Therefore, an angle at which the first depressed portion 518*a* and the second depressed portion 518*b* intersect is 90°. Further, the first depressed portion 518*a* and the second depressed portion 518*b* are formed at an equal pitch PI in the axial direction and the circumferential direction of the developing roller 510.

The projecting portion 519 is provided surrounded by two types of the depressed portions (i.e., the first depressed portion 518*a* and the second depressed portion 518*b*), as shown in FIG. 9. The projecting portion 519 has a top surface 519*a*, and a side surface 519*b* which is connected to the top surface 519*a*, as shown in FIG. 11.

The top surface 519*a* has a flat section formed thereon. The top surface 519*a* is substantially square-shaped, as shown in FIG. 10. The top surface 519*a* is formed such that, among two diagonal lines of the square of the top surface 519*a* , one of the diagonal lines is in the axial direction of the developing roller 510 and the other is in the circumferential direction of the developing roller 510. A width of the top surface 519*a* is approximately 30 μm in this embodiment.

As shown in FIG. 11, the side surface 519*b* is connected to a flat bottom surface 518*c* of the depressed portion 518 and is a surface inclined to the bottom surface 518*c*. An inclination angle of the side surface 519*b*, to the bottom surface 518*c* of the depressed portion 518 (an angle indicated by symbol β in FIG. 11) is equal to or less than 45°, and the inclination angle in this embodiment is 45°.

Further, a height of the projecting portion 519 (a depth of the depressed portion 518), that is, a distance between the top surface 519*a* of the projecting portion 519 and the bottom surface 518*c* of the depressed portion 518 is equal to or less than twice a volume-weighted average diameter of a toner (7 μm). Note that, in this embodiment, the depth of the depressed portion 518 is approximately 7 μm and is the same size as the volume-weighted average diameter of a toner. Further, a groove angle (an angle indicated by symbol α in FIG. 11) is approximately 90°.

The non-indentation-processed section 514 is a section on the surface of which the above-mentioned indentation process (rolling) is not processed, as shown in FIG. 9. The non-indentation-processed section 514 is located between the indentation-processed section 512 and the shaft portion 510*b* in the axial direction of the developing roller 510, and its surface is smooth (ten-point average height of irregularities Rz of the surface is 1 μm or less).

Figure 12A:
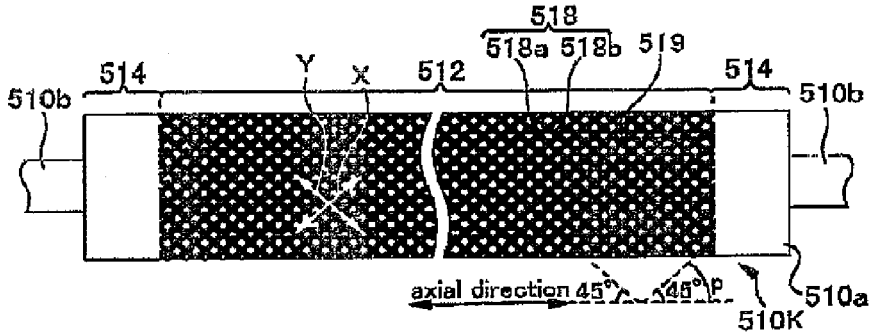
FIG. 12A is a diagram of a developing roller 510 of a black developing device 51.
Figure 12B:
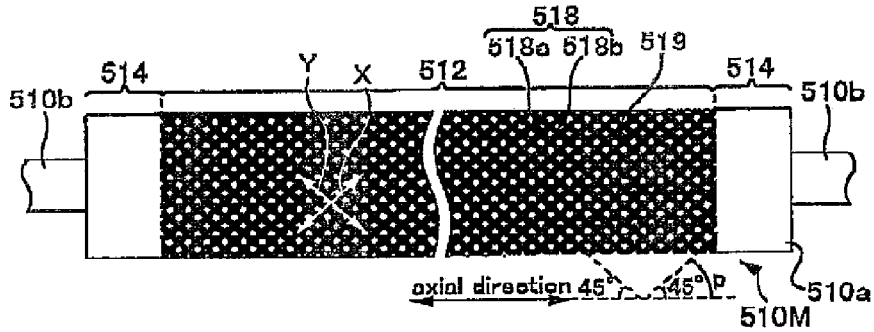
FIG. 12B is a diagram of a developing roller 510 of a magenta developing device 52.
Figure 12C:
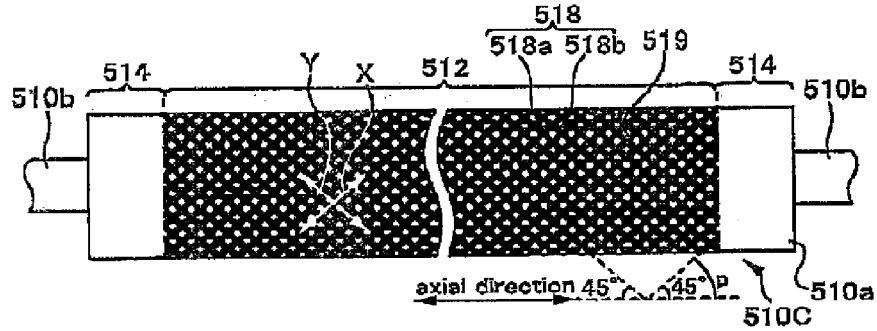
FIG. 12C is a diagram of a developing roller 510 of a cyan developing device 53.
Figure 12D:
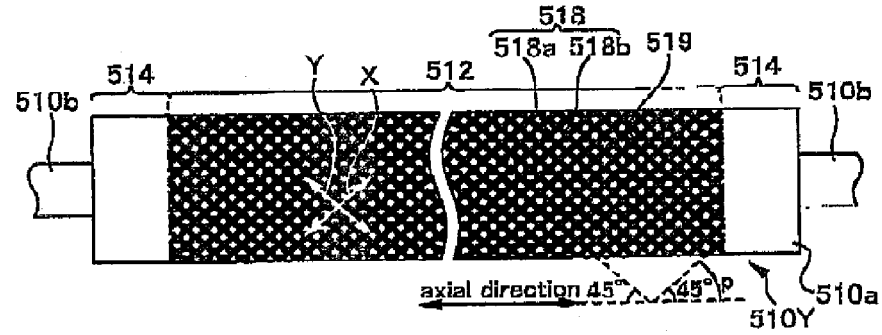
FIG. 12D is a diagram of a developing roller 510 of a yellow developing device 54.

Though the developing roller 510 of the yellow developing device 54 is described in the foregoing, the printer 10 includes the four developing rollers 510 which bear toners of four respective colors. The four developing rollers 510 have the same structure, and their depressed portions 518 (the first depressed portions 518*a* ) have the same inclination angle p. More specifically, in the developing roller 510 of each developing device, the inclination angle p of the depressed portion 518 (the first depressed portion 518*a* ) is 45°, as shown in FIGS. 12A through 12D. Note that FIGS. 12A through 12D are front views of the schematic diagram of the developing roller 510. FIG. 12A shows the developing roller 510 of the black developing device 51 (hereinafter also referred to as a black developing roller 510K), FIG. 12B shows the developing roller 510 of the magenta developing device 52 (hereinafter also referred to as a magenta developing roller 510M), FIG. 12C shows the developing roller 510 of the cyan developing device 53 (hereinafter also referred to as a cyan developing roller 510C), and FIG. 12D shows the developing roller 510 of the yellow developing device 54 (hereinafter also referred to as a yellow developing roller 510Y).

Regarding Method of Manufacturing Developing Roller 510

Figure 13A:
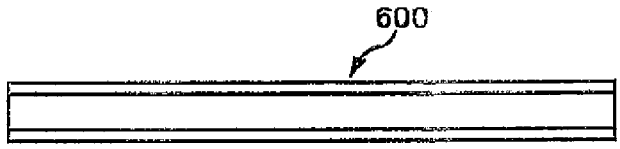
FIG. 13A is a (first) schematic diagram showing transition of the developing roller 510 in its manufacturing processes.
Figure 13B:
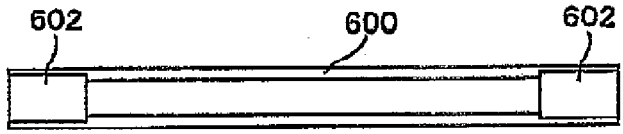
FIG. 13B is a (second) schematic diagram showing transition of the developing roller 510 in its manufacturing processes.
Figure 13C:
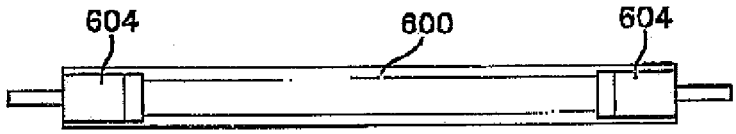
FIG. 13C is a (third) schematic diagram showing transition of the developing roller 510 in its manufacturing processes.
Figure 13D:
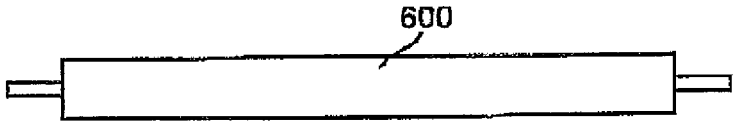
FIG. 13D is a (fourth) schematic diagram showing transition of the developing roller 510 in its manufacturing processes.
Figure 13E:
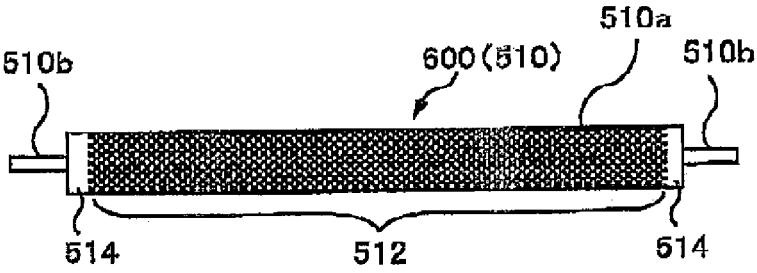
FIG. 13E is a (fifth) schematic diagram showing transition of the developing roller 510 in its manufacturing processes.
Figure 14:
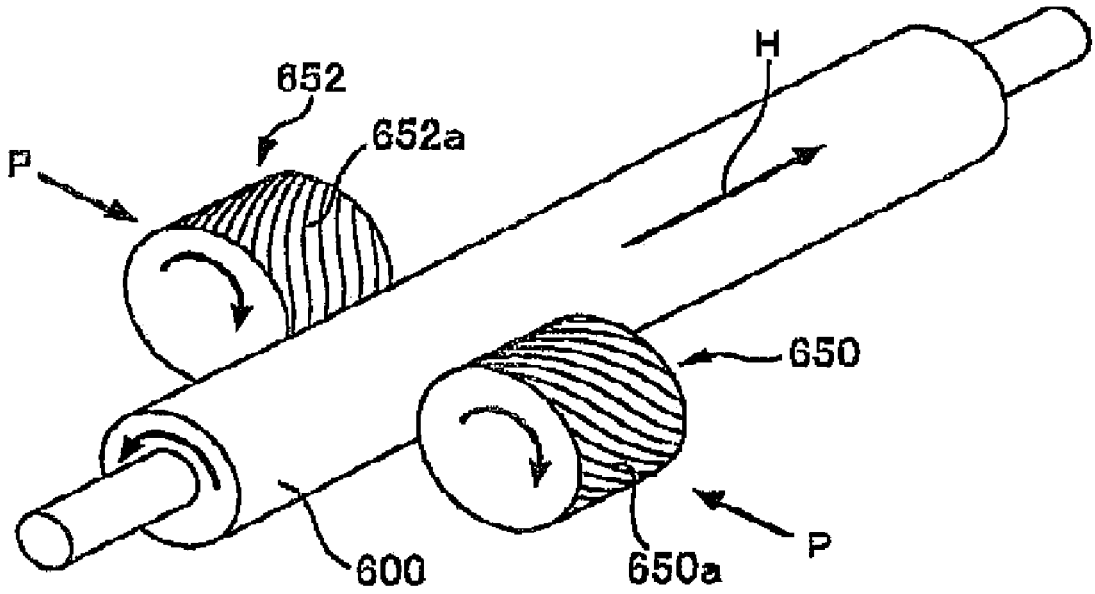
FIG. 14 is an explanatory diagram for describing rolling of the developing roller 510.

A method for manufacturing each of the four developing rollers 510 is the same because the four developing rollers 510 have the same structure as mentioned above. Accordingly, a method of manufacturing the developing roller 510 of the yellow developing device 54 is described hereinbelow with reference to FIGS. 13A through 13E and 14. FIGS. 13A through 13E are schematic diagrams showing transition of the developing roller 510 in its manufacturing processes. FIG. 14 is an explanatory diagram for describing rolling of the developing roller 510. Note that FIGS. 13A through 13C show a cross-section of a pipe 600, and that FIGS. 13D and 13E shows an outer peripheral surface of the pipe 600.

First, as shown in FIG. 13A, prepare the pipe 600 as a base material for the cylindrical portion 510*a* of the developing roller 510. Wall thickness of the pipe 6 is 0.5 through 3 mm. Next, as shown in FIG. 13B, on both end portions, in the longitudinal direction, of the pipe 600 are formed a flange press-fit section 602. The flange press-fit section 602 is formed by machining. Next, as shown in FIG. 13C, a flange 604 is forced into the flange press-fit section 602 that structures the shaft portion 510*b* of the developing roller 510. After forcing the flange 604 thereinto, the flange 604 can be bonded or welded to the pipe 600 in order to secure the flange 604 to the pipe 600.

Next, as shown in FIG. 13D, centerless polishing is performed on a surface of the pipe 600 into which the flange 604 is forced. The centerless polishing is performed on the entire surface, and after the centerless polishing, ten-point average height of irregularities Rz of the surface is 1.0 μm or less. Next, as shown in FIG. 13E, the depressed portion 518 and the projecting portion 519 are formed by rolling in a section which is in the pipe 600 into which the flange 604 is forced and which will serve as the indentation-processed section 512. In this embodiment, so-called through-feed rolling process which uses two round dies 650, 652 is performed.

More specifically, as shown in FIG. 14, the two round dies 650, 652 are positioned such that they sandwich the pipe 6 serving as a workpiece, and the two round dies 650, 652 rotate in the same direction (see FIG. 14) while pressing the two round dies 650, 652 against the pipe 600 with a predetermined pressure (a direction of the pressure is indicated by symbol P in FIG. 14). The round dies 650, 652 are furnished, on a surface thereof, with projections 650*a*, 650*a* which are for forming the depressed portion 518. The projections 650*a*, 650*a* deform the pipe 600 so that the depressed portion 518 and the projecting portion 519 are formed on the pipe 600. Note that, in through-feed rolling, the rotation of the round dies 650, 652 makes the pipe 600 move towards a direction indicated by symbol H in FIG. 14 with the pipe 600 rotating in a direction opposite the rotating direction of the round dies 650, 652 (see FIG. 14). In a section to serve as the indentation-processed section 512, the first depressed portion 518*a* in the depressed portion 518 is formed by the projection 650*a* , of the round die 650 and the second depressed portion 518*b* in the same is formed by the projection 650*a*of the round die 652.

First Embodiment

Regarding Halftone Screen of Printer 10 according to First Embodiment

The printer 10 forms a halftone image by causing the developing device to develop dot-like latent images which are borne on the photoconductor 20, according to the image data PD sent from the image processing section 797. Here, halftone means spots of various sizes which are sizes somehow indistinguishable to the unaided eye in an image having multiple tone levels and are arranged at regular intervals. The printer 10 can represent density of an image by varying the size of halftones. The image processing section 797 converts the image data AD to the image data PD according to so-called halftone screen (hereinafter also referred to merely as a screen) such that halftones are formed.

Figure 15A:
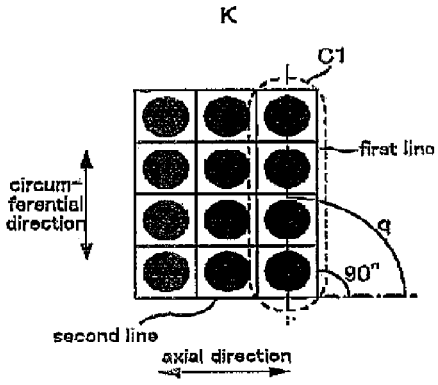
FIG. 15A is a schematic diagram showing a black screen.
Figure 15B:
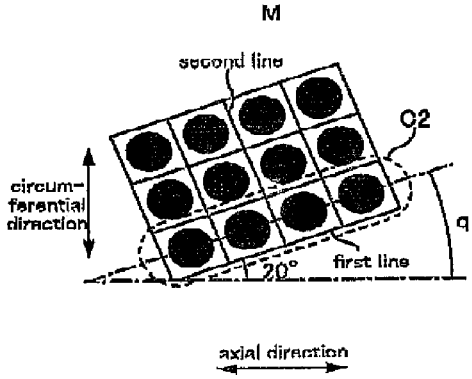
FIG. 15B is a schematic diagram showing a magenta screen.
Figure 15C:
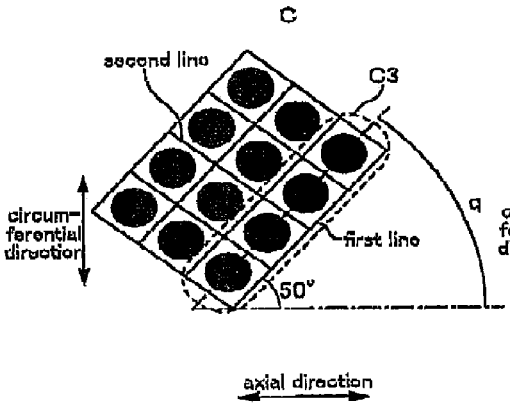
FIG. 15C is a schematic diagram showing a cyan screen.
Figure 15D:
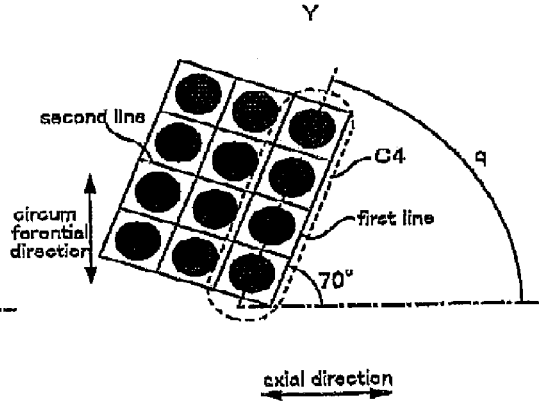
FIG. 15D is a schematic diagram showing a yellow screen.

The screen is described with reference to FIGS. 15A through 15D. FIG. 15A is a schematic diagram showing a black screen, FIG. 15B is a schematic diagram showing a magenta screen, FIG. 15C is a schematic diagram showing a cyan screen, and FIG. 15D is a schematic diagram showing a yellow screen. Note that, in FIGS. 15A through 15D, a direction corresponding to the axial direction of the photoconductor 20 (hereinafter also referred to merely as an axial direction) and a direction corresponding to a circumferential direction of the photoconductor 20 (hereinafter also referred to merely as a circumferential direction) are indicated by arrows.

In the screen, a large number of cells (squares in FIG. 15A, etc.) are constructed by first lines and second lines which intersect each other, as shown in FIG. 15A, etc. The photoconductor 20 bears dot-like latent images (filled circles in FIG. 15A, etc.) in each of the cells, so that halftones can be formed. Note that the dot-like latent images are borne by the photoconductor 20 such that the center of each dot-like latent image is located at the center of each cell.

The screen is provided for each color, that is, a black screen in FIG. 15A, a magenta screen in FIG. 15B, a cyan screen in FIG. 15C, and a yellow screen in FIG. 15D are provided. The photoconductor 20 bears black dot-like latent images by the black screen, magenta dot-like latent images by the magenta screen, cyan dot-like latent images by the cyan screen, and yellow dot-like latent images by the yellow screen, respectively.

Though the cells of the above-mentioned four screens are the same in size, the first and second lines of each of the screens are arranged differently. More specifically, in the black screen, the first lines are parallel to the circumferential direction (in other words, the first lines are perpendicular to the axial direction), and the second lines are parallel to the axial direction. On the other hand, in the magenta screen, the cyan screen, and the yellow screen, the first and second lines are inclined relative to the axial direction and to the circumferential direction. Here, an inclination angle of the first lines relative to the axial direction is defined as a screen angle. Screen angles of the black screen, the magenta screen, the cyan screen, and the yellow screen are 90°, 20°, 50°, and 70° respectively.

Note that, a plurality of divided regions arranged in rows along a direction intersecting the axial direction of the central axis of the photoconductor 20 at a predetermined intersection angle q (hereinafter also referred to as an intersection direction) are indicated in FIGS. 15A through 15D as follows: in the black screen, cells surrounded by circle C1 in FIG. 15A (hereinafter also referred to as a divided-region row C1), in the magenta screen, cells surrounded by circle C2 in FIG. 15B (hereinafter also referred to as a divided-region row C2), in the cyan screen, cells surrounded by circle C3 in FIG. 15C (hereinafter also referred to as a divided-region row C3), and in the yellow screen, cells surrounded by circle C4 in FIG. 15D (hereinafter also referred to as a divided-region row C4).

The divided-region row C1 in the black screen, the divided-region row C2 in the magenta screen, the divided-region row C3 in the cyan screen, and the divided-region row C4 in the yellow screen are arranged along the first line respectively. Therefore, an intersection angle q of the divided-region row C1 is the same as the screen angle of the black screen (i.e., 90°), an intersection angle q of the divided-region row C2 is the same as the screen angle of the magenta screen (i.e., 20°), an intersection angle q of the divided-region row C3 is the same as the screen angle of the cyan screen (i.e., 50°), and an intersection angle q of the divided-region row C4 is the same as the screen angle of the yellow screen (i.e., 70°).

The intersection angle q of the divided-region row of each of the four screens is different from each other because, as mentioned above, the intersection angle q of the divided-region row C1 of the black screen is 90°, the intersection angle q of the divided-region row C2 of the magenta screen is 20°, the intersection angle q of the divided-region row C3 of the cyan screen is 50°, and the intersection angle q of the divided-region row C4 of the yellow screen is 70°.

Regarding Positional Relationship between Depressed Portion 518 and Divided-Region Row of Screen, in Printer 10 according to First Embodiment As mentioned above, the developing roller 510 includes the depressed portion 518, serving as a helical groove portion, which is inclined at a predetermined inclination angle p to the axial direction of the developing roller 510 and is formed having a uniform pitch in the axial direction. Using the toner borne by the developing roller 510 which includes the depressed portion 518, dot-like latent images on the photoconductor 20 are made visible as a toner image. At this stage, there are cases in which unevenness in density caused by the depressed portion 518 may occur periodically in the toner image (for example, unevenness in density which is caused because an amount of toner borne by the depressed portion 518 is more than an amount of toner borne by any other section than the depressed portion 518 (i.e., the projecting portion 519)).

In addition, as mentioned above, the photoconductor 20 bears dot-like latent images on each of the cells of the screen. If the dot-like latent images are borne by each of a plurality of the divided regions (the divided-region rows) which are arranged in rows along an intersection direction intersecting the axial direction of the central axis of the photoconductor 20 at the predetermined intersection angle q, a plurality of the dot-like latent images are formed in the intersection direction.

Figure 17A:
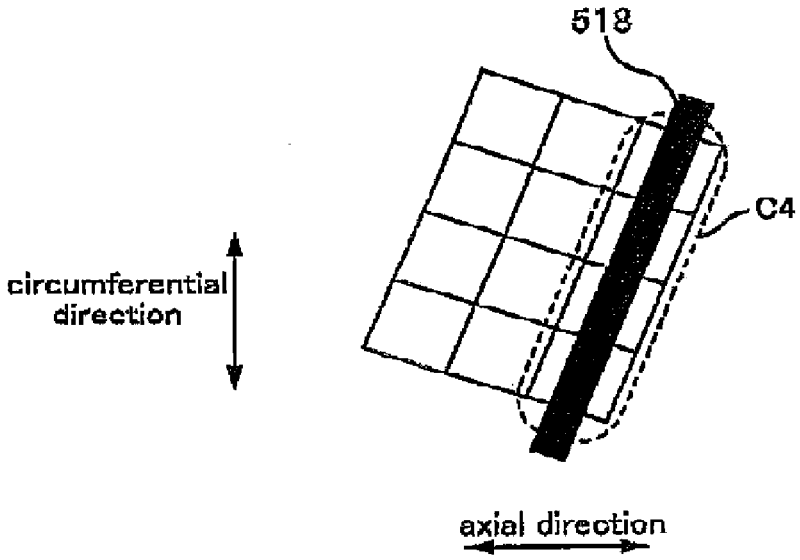
FIG. 17A is a schematic diagram for describing a comparison example.

Under such a circumstance, depending on a relative position of each divided-region row in the screen and the depressed portion 518, unevenness in density caused by the depressed portion 518 may become conspicuous in the toner image which has been made visible. For example, when the photoconductor 20 and the developing roller 510 rotate in order to develop dot-like latent images, if the relative position of each divided-region row with respect to the depressed portion 518 is the same, there are cases in which a dot-like latent image borne by each divided-region row is made visible as a toner image by toner borne on a same area of the depressed portion 518, as shown in FIG. 17A. In such a case, unevenness in density caused by the depressed portion 518 may become conspicuous in the toner image which has been made visible. Note that FIG. 17A is a schematic diagram for describing a comparison example, and shows a case in which an apparent inclination angle of the depressed portion 518 of the yellow developing roller 510Y and the intersection angle q of the divided-region row C4 of the yellow screen are the same.

In order to prevent unevenness in density from becoming conspicuous in the printer 10 according to the first embodiment, the positional relationship between the depressed portion 518 and the divided-region row is as follows: in the rotation of the developing roller 510 and the photoconductor 20, an intersection angle of the yellow screen is different from the apparent inclination angle, as seen from the photoconductor 20, of the depressed portion 518 (the first depressed portion 518*a* ) of the developing roller 510. More specifically, a value which is a tangent of the inclination angle p (tan p) of the depressed portion 518 divided by a ratio of a moving speed of the surface of the developing roller 510 to a moving speed of the surface of the photoconductor 20 (hereinafter also referred to as a speed ratio) is different from a tangent of the intersection angle q of the divided-region row (tan q). The section below describes this in greater detail.

In the first embodiment, a first developer can be any toner among toners of four colors, and hereinbelow yellow toner serves as the first developer. In such a case, among the four screens, the divided-region rows of the yellow screen serve as a first divided-region group which bears dot-like latent images which are made visible by the first developer as a toner image. Therefore, the depressed portion 518 of the yellow developing roller 510Y and the divided-region row C4 of the yellow screen are described as an example.

Figure 16:
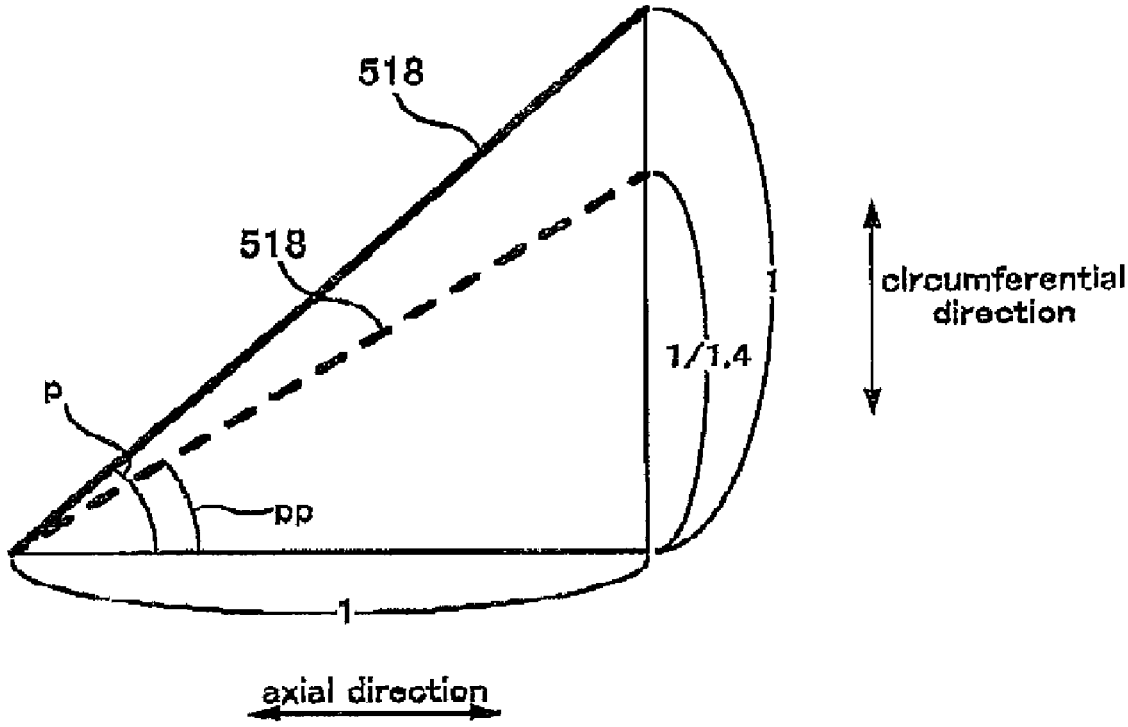
FIG. 16 is a diagram conceptually showing calculation of the tangent of an inclination angle p giving consideration to a speed ratio.

As mentioned above, the moving speed of the surface of the yellow developing roller 510Y is different from the moving speed of the surface of the photoconductor 20 (in this embodiment, the moving speed of the surface of the developing roller 510 is 1.4 times the moving speed of the surface of the photoconductor 20). The speed ratio is 1.4, and thus, the tangent of an apparent inclination angle pp of the depressed portion 518 shown in FIG. 16, is a value (i.e., 0.7) of the tangent of the actual inclination angle p of the depressed portion 518 (i.e., 1) divided by the speed ratio (i.e., 1.4). Note that FIG. 16 is a conceptual diagram for describing the apparent inclination angle pp of the depressed portion 518. In FIG. 16, the depressed portion 518 having the inclination angle p is indicated by a thick line and the depressed portion 518 having the apparent inclination angle pp is indicated by a dotted line.

The tangent of the intersection angle q of the above-mentioned yellow screen is 2.75. Therefore, a value of the tangent of the inclination angle p of the depressed portion 518 of the yellow developing roller 510Y divided by the speed ratio (i.e., 0.71) is different from the tangent of the intersection angle q of the divided-region row C4 of the yellow screen (i.e., 2.75).

Figure 17B:
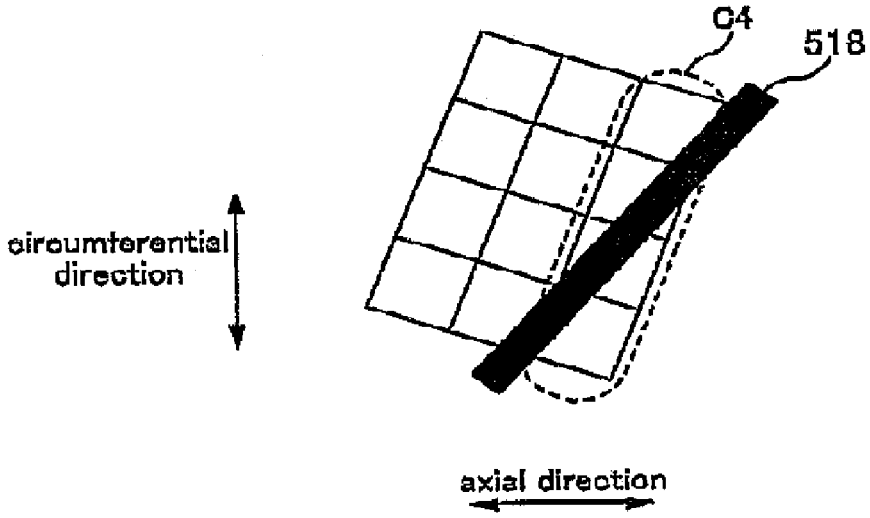
FIG. 17B is a schematic diagram for describing effectiveness of the printer 10 according to the first embodiment.

In this way, in the case where the value is different from the tangent of the intersection angle q as shown in FIG. 17B, when dot-like latent images are made visible as a toner image by the rotation of the developing roller 510 and the photoconductor 20, the apparent inclination angle, as seen from the photoconductor 20, of the depressed portion 518 of the yellow developing roller 510Y is different from intersection angle of the yellow screen. This enables to prevent dot-like latent images which are borne by each divided-region row of the yellow screen, from being made visible as a toner image by toner borne on a same area of the depressed portion 518 (or, on a same area of the projecting portion 519). Accordingly, with the printer 10 according to the first embodiment, it is possible to prevent unevenness in density from becoming conspicuous. Note that FIG. 17B is a schematic diagram for describing effectiveness of the printer 10 according to the first embodiment, and shows a state in which the apparent inclination angle of the depressed portion 518 of the yellow developing roller 510Y and the intersection angle q of the divided-region row C4 of the yellow screen are different from each other.

Positional Relationship between Depressed Portions 518 of Four Developing Rollers 510 and Four Divided-Region Rows In the foregoing, the depressed portion 518 of the yellow developing roller 510Y and the divided-region row C4 of yellow screen are described as an example. This section describes a positional relationship between the following four developing rollers 510 and divided-region rows: the four developing rollers 510 which bear toners of four respective colors, and the divided-region rows which are in each of the four screens (the yellow screen, the magenta screen, the cyan screen, and the black screen) and which bear thereon dot-like latent images to be made visible by toners of four respective colors as a toner image.

The section below describes the positional relationship between the depressed portion 518 of the yellow developing roller 510Y and divided-region rows of the four screens. And thereafter, the section describes the positional relationship between the depressed portion 518 of the four developing rollers 510 including the yellow developing roller 510Y, and divided-region rows of each of the four screens including the yellow screen.

First, the positional relationship between the depressed portion 518 of the yellow developing roller SlOY and divided-region rows of the four screens is described. In the first embodiment, it is only essential that second developer whose color is different from a color of the first developer is any other toner than yellow toner among toners of four colors, so magenta toner serves as the second developer hereinbelow. In such a case, the divided-region row C2 of the magenta screen, among the four screens, serves as a second divided-region group which bears dot-like latent images to be made visible as a toner image by the second developer.

In this case, tangent of the intersection angle q of the divided-region row C2 is 0.36 because the intersection angle q of the divided-region row C2 of the magenta screen is 20° as mentioned above. Therefore, a value which is the tangent of the inclination angle p of the depressed portion 518 of the yellow developing roller 510Y divided by the speed ratio (i.e., 0.71) is different from the tangent of the intersection angle q of the magenta screen (i.e., 0.36).

Similarly, the tangent of the intersection angle q of the divided-region row C3 is 1.19 because the intersection angle q of the divided-region row C3 of the cyan screen is 50°. The tangent of the intersection angle q of the divided-region row C1 is infinite because the intersection angle q of the divided-region row C1 of the black screen is 90°. Therefore, a value which is the tangent of the inclination angle p of the depressed portion 518 of the yellow developing roller 510Y divided by the speed ratio is different from the tangent of the intersection angle q of the divided-region row C3 of the cyan screen and is also different from the tangent of the intersection angle q of the divided-region row C1 of the black screen.

As mentioned above, in the first embodiment, a value which is the tangent of the inclination angle p of the depressed portion 518 of the yellow developing roller 510Y divided by the speed ratio (i.e., 0.71) is different from the tangent of the intersection angle q of the four screens.

Next, the section below describes the positional relationship between the depressed portion 518 of the four developing rollers 510 including the yellow developing roller 510Y and divided-region rows of each of the four screens including the yellow screen.

The inclination angle p of the depressed portion 518 is the same (i.e., 45°) among the four developing rollers 510 as mentioned above, so tangent of the inclination angle p is the same among the four developing rollers 510. Besides, as mentioned above, a value (i.e., 0.71) which is the tangent of the inclination angle p of the depressed portion 518 of the yellow developing roller 510Y divided by a ratio (i.e., 1.4) of a moving speed of a surface of each of the developing rollers 510 to a moving speed of the surface of the photoconductor 20 is different from the tangent of the intersection angle q of the divided-region row of any of the four screens. Accordingly, regarding the tangent, a value which is the tangent of the inclination angle p of the depressed portion 518 of the four developing rollers 510 divided by a ratio of the moving speed of the surface of each of the developing rollers 510 to the moving speed of the surface of the photoconductor 20 is different from the tangent of the intersection angle q of the divided-region row of any of the four screens.

Regarding Modified Example of First Embodiment

Figure 18A:
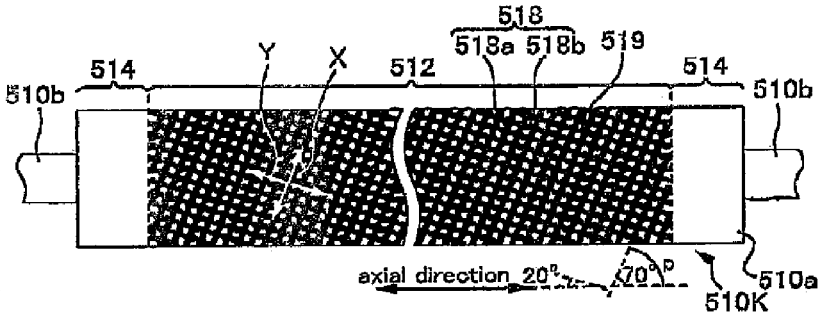
FIG. 18A is a diagram showing a developing roller 510 of a black developing device 51 according to the modified example of the first embodiment.
Figure 18B:
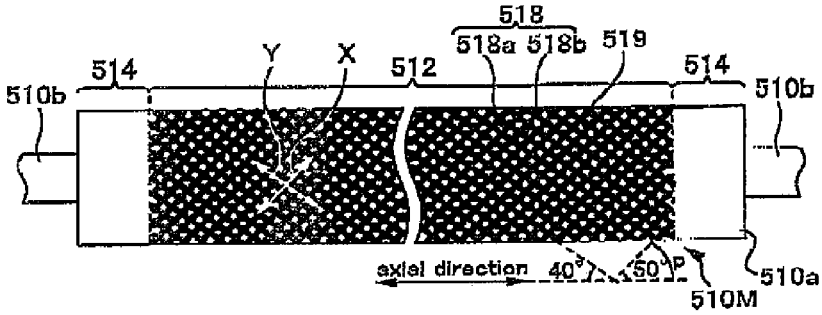
FIG. 18B is a diagram showing a developing roller 510 of a magenta developing device 52 according to the modified example of the first embodiment.
Figure 18C:
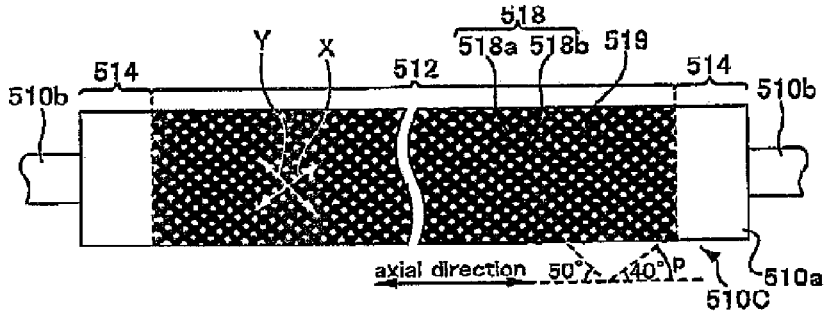
FIG. 18C is a diagram showing a developing roller 510 of a cyan developing device 53 according to the modified example of the first embodiment.
Figure 18D:
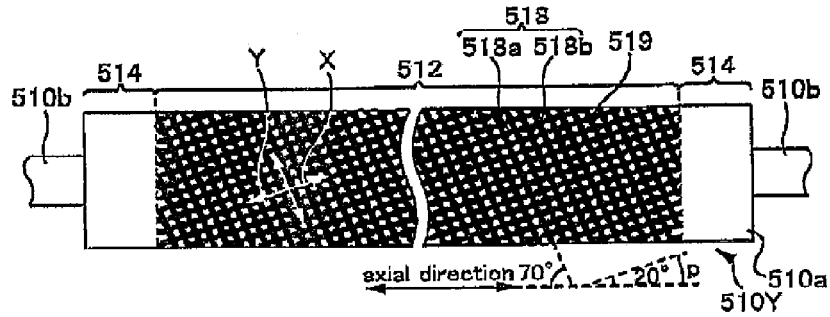
FIG. 18D is a diagram showing a developing roller 510 of a yellow developing device 54 according to the modified example of the first embodiment.

Next, with reference to FIGS. 18A through 18D, a modified example of the first embodiment is described. FIGS. 18A through 18D are front views of schematic diagrams of the developing roller 510; FIG. 18A shows the developing roller 510 of the black developing device 51, FIG. 18B shows the developing roller 510 of the magenta developing device 52, FIG. 18C shows the developing roller 510 of the cyan developing device 53, and FIG. 18D shows the developing roller 510 of the yellow developing device 54.

The section below mainly describes the positional relationship between the depressed portion 518 of the developing roller 510 and the divided-region rows of the screens. Accordingly, a structure of the printer 10 which is the same as the printer 10 according to the first embodiment is not described.

In the modified example, the first developer and the second developer can be any toner among toners of four colors, so yellow toner serves as the first developer and magenta toner serves as the second developer in the same way as the first embodiment. In such a case, the yellow developing roller 510Y and the magenta developing roller 510M serve respectively as a first developer bearing roller bearing the first developer and a second developer bearing roller bearing the second developer. The divided-region row C4 of the yellow screen and the divided-region row C2 of the magenta screen serve respectively as the first divided-region group and the second divided-region group. First, the section below describes the positional relationship between the depressed portion 518 of the yellow developing roller 510Y and the magenta developing roller 510M, and the divided-region rows of the yellow screen and the magenta screen.

The yellow screen and the magenta screen according to the modified example are respectively the same as the yellow screen and the magenta screen according to the first embodiment, and so the intersection angle q of the divided-region row C4 of the yellow screen is 70°, and the intersection angle q of the divided-region row C2 of the magenta screen is 20°. On the other hand, the inclination angle p of the depressed portion 518 of the yellow developing roller 510Y (the first depressed portion 518*a*) is different from that of the first embodiment, that is, 70° as shown in FIG. 18D. Also, the inclination angle p of the depressed portion 518 of the magenta developing roller 510M (the first depressed portion 518*a* ) is also different from that of the first embodiment, that is 50° as shown in FIG. 18B. Therefore, the inclination angle p of the depressed portion 518 of the yellow developing roller 510Y is different from the inclination angle p of the depressed portion 518 of the magenta developing roller 510M.

In this case, the tangent of the inclination angle p of the depressed portion 518 of the yellow developing roller 510Y is 2.75, so a value which is the tangent divided by the speed ratio (i.e., 1.4) is 1.96. The value is different from the tangent of the intersection angle q of the divided-region row C4 of the yellow screen (i.e., 2.75), and is also different from the tangent of the intersection angle q of the divided-region row C2 of the magenta screen (i.e., 0.36). Similarly, the tangent of the inclination angle p of the depressed portion 518 of the magenta developing roller 510M is 1.19, so a value which is the tangent divided by the speed ratio is 0.85. Also, the value is different from the tangent of the intersection angle q of the divided-region row of the yellow screen (i.e., 2.75), and is also different from the tangent of the intersection angle q of the divided-region row of the magenta screen (i.e., 0.36).

Next, the section below describes the relationship between the inclination angle p of the depressed portion 518 of the four developing rollers 510 and the intersection angle q of the divided-region row of each of the four screens; the four developing rollers 510 includes the yellow developing roller 510Y and the magenta developing roller 510M, and the four screens includes the yellow screen and the magenta screen.

The cyan screen and the magenta screen according to the modified example are respectively the same as the cyan screen and the magenta screen according to the first embodiment, and so the intersection angle q of the divided-region row C3 of the cyan screen is 50°, and the intersection angle q of the divided-region row C1 of the black screen is 90°. The intersection angle q of the divided-region row is different among the four screens because the intersection angle q of the divided-region row C4 of the yellow screen is 20° and the intersection angle q of the divided-region row C2 of the magenta screen is 70°, as mentioned above.

Further, the inclination angle p of the depressed portion 518 of the cyan developing roller 510C is different from that of the first embodiment, that is, 40° as shown in FIG. 18C. Also, the inclination angle p of the depressed portion 518 of the black developing roller 510K is different from the first embodiment, that is, 20° as shown in FIG. 18A. In the modified example, the inclination angle p of the depressed portion 518 is different in degree among the four developing rollers 510 because the inclination angle p of the yellow developing roller 510Y is 70° and the inclination angle p of the magenta developing roller 510M is 50° as mentioned above.

In this case, the tangent of the inclination angle p of the depressed portion 518 of the cyan developing roller 510C is 0.84, so a value which is the tangent divided by the speed ratio (i.e., 1.4) is 0.6. The tangent of the inclination angle p of the depressed portion 518 of the black developing roller 510K is 0.36, so a value which is the tangent divided by the speed ratio is 0.26. As mentioned above, a value which is the tangent of the inclination angle p of the depressed portion 518 of the yellow developing roller 510Y divided by the speed ratio is 1.96, and a value which is the tangent of the inclination angle p of the depressed portion 518 of the magenta developing roller 510Y divided by the speed ratio is 0.85.

The above-mentioned four values are different from the following four tangent: the tangent of the intersection angle q of the divided-region row C4 of the yellow screen (i.e., 2.75), the tangent of the intersection angle q of the divided-region row C2 of the magenta screen (i.e., 0.36), the tangent of the intersection angle q of the divided-region row C3 of the cyan screen (i.e., 1.19), and the tangent of the intersection angle q of the divided-region row C1 of the black screen (i.e., infinite) . In this way, each value which is each inclination angle p of the depressed portion 518 of the four developing rollers 510 divided by a ratio of a moving speed of the surface of each of the developing rollers 510 to a moving speed of the surface of the photoconductor 20 is different from the intersection angle q of divided-region row of any of the four screens.

In the above-mentioned printer 10, a value which is the tangent of the inclination angle p of the yellow developing roller 510Y divided by the speed ratio is different from the tangent of the intersection angle q of the divided-region row C4 of the yellow screen, in the same way as the printer 10 according to the first embodiment. In such a case, when dot-like latent images are made visible as a toner image by the rotation of the developing roller 510 and the photoconductor 20, the inclination angle, as seen from the photoconductor 20, of the depressed portion 518 of the yellow developing roller 510Y is different from the intersection angle of the yellow screen, in the same way as the first embodiment. This enables to prevent dot-like latent images which are borne by each divided-region row of the yellow screen, from being made visible as a toner image by toner borne on a same area of the depressed portion 518 (or, on a same area of the projecting portion 519). Accordingly, with the printer 10 according to the modified example, it is possible to prevent unevenness in density from becoming conspicuous.

Figure 19A:
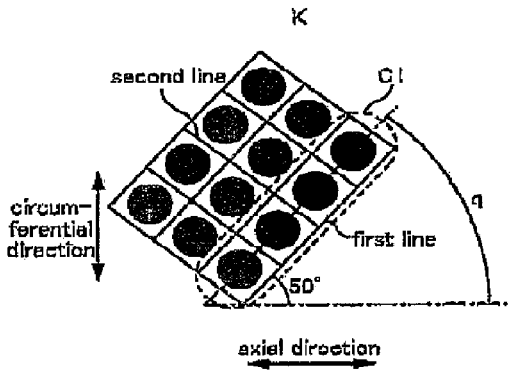
FIG. 19A is a schematic diagram showing a black screen according to the modified example of the first embodiment.
Figure 19B:
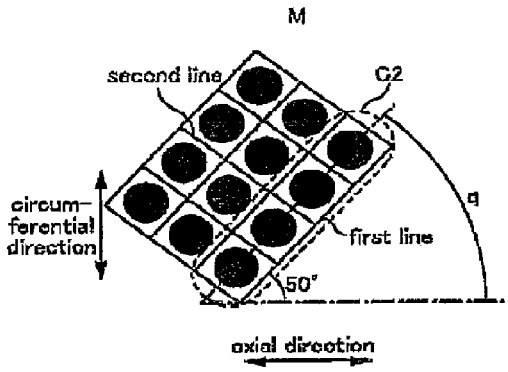
FIG. 19B is a schematic diagram showing a magenta screen according to the modified example of the first embodiment.
Figure 19C:
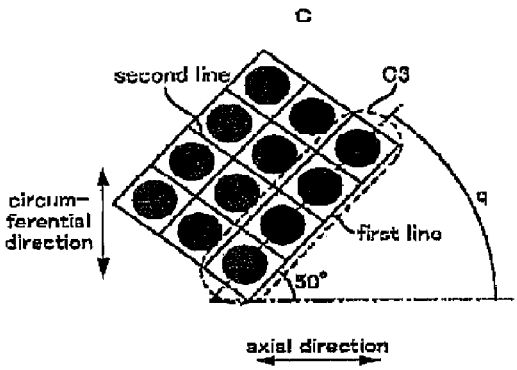
FIG. 19C is a schematic diagram showing a cyan screen according to the modified example of the first embodiment.
Figure 19D:
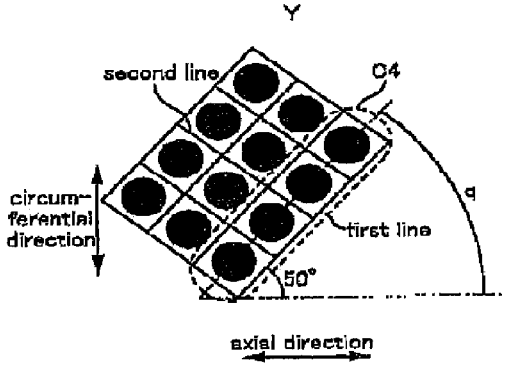
FIG. 19D is a schematic diagram showing a yellow screen according to the modified example of the first embodiment.

In the foregoing, the intersection angle q of the divided-region row is different among the four screens, as shown in FIGS. 19A through 19D. However, it is also possible the intersection angle q of the divided-region row is the same among the four screens. FIG. 19A is a schematic diagram showing the black screen, FIG. 19B is a schematic diagram showing the magenta screen, FIG. 19C is a schematic diagram showing the cyan screen, and FIG. 19D is a schematic diagram showing the yellow screen.

The intersection angle q of the divided-region row of the yellow screen shown in FIG. 19A, the intersection angle q of the divided-region row of the magenta screen shown in FIG. 19B, the intersection angle q of the divided-region row of the cyan screen shown in FIG. 19C, and the intersection angle q of the divided-region row of the black screen shown in FIG. 19D are 50°. In this case, the tangent of the intersection angle q of the divided-region row of each of the four screens is 1.19. This value is different from all of the values which are the tangent of the inclination angle p of the depressed portion 518 of each of the four developing rollers 510 divided by the ratio of the moving speed of the surface of each of the developing rollers 510 to the moving speed of the surface of the photoconductor 20 (i.e., 0.26, 0.6, 0.85, and 1.96).

Furthermore, in the foregoing, the inclination angle p is different among the four developing rollers 510, but this invention is not limited thereto. For example, the inclination angles p of any two of the four developing rollers 510 can be the same.

Second Embodiment

Regarding Positional Relationship between Indentation-Processed Section 512 and Divided Regions, of Printer 10 according to Second Embodiment The photoconductor 20 bears dot-like latent images by the divided regions which are divided into lattices. A plurality of the divided regions exist in this embodiment, and are located in rows along the axial direction and the circumferential direction of the photoconductor 20.

The printer 10 according to this embodiment can form an image with a resolution of 200 dpi to 600 dpi; for example, it forms, with a resolution of 600 dpi, an image which does not occupy a wide area, such as characters and line drawings, and forms, with a resolution of 200 dpi, an image which occupies a wide area, such as photographs and illustrations. The printer 10 changes pitches of lattices which form divided regions, depending on the resolution. More specifically, the lattices which form divided regions can be formed having a plurality of types of pitches in the circumferential direction and in the axial direction of the surface of the photoconductor 20. For example, in the case of 600 dpi resolution in the axial direction of the photoconductor 20, a pitch of the lattices in the axial direction is approximately 42 μm (see FIG. 20A), and in the case of 200 dpi resolution in the axial direction of the photoconductor 20, a pitch of the lattices in the axial direction is approximately 126 μm (see FIG. 21A).

The section below describes the positional relationship, in the axial direction and the circumferential direction of the photoconductor 20, between the indentation-processed section 512 of the developing roller 510 and the divided regions, in the case of 600 dpi resolution. Also, the section describes the positional relationship, in the axial direction and the circumferential direction of the photoconductor 20, between the indentation-processed section 512 and the divided regions, in the case of 200 dpi resolution.

In the case of 600 dpi resolution

First, positional relationship between the indentation-processed section 512 of the developing roller 510 and the divided regions in the case of 600 dpi resolution is described. Note that, as the positional relationship of the indentation-processed section 512 and the divided regions, this section describes the positional relationship in the circumferential direction of the photoconductor 20 and the positional relationship in the axial direction of the photoconductor 20.

Positional Relationship, in Circumferential Direction of Photoconductor 20, between Indentation-Processed Section 512 and Divided Regions First, with reference to FIGS. 10, 20A through 20C, this section describes a positional relationship, in the circumferential direction of the photoconductor 20, between the indentation-processed section 512 and the divided regions.

FIG. 10 illustrates straight lines D1, D2, D3 which are located at a uniform spacing, and these straight lines D1, D2, D3 indicate positions of respective portions, of the indentation-processed section 512, that are along the axial direction of the developing roller 510. Note that the portion whose position is indicated by the straight line D1 is referred to as a portion D1, the portion whose position is indicated by the straight line D2 is referred to as a portion D2, and the portion whose position is indicated by the straight line D3 is referred to as a portion D3, for the sake of convenience. In this case, the portion D1 and the portion D2 serve respectively as an axial-direction first portion and an axial-direction second portion.

The portion D1 is a portion that passes through either one of the two diagonal lines of the top surface 519*a* of the projecting portion 519, whichever is parallel to the axial direction, as shown in FIG. 10. The portion D2 is adjacent to the portion D1 in the circumferential direction of the developing roller 510 (specifically, adjacent to a lower section of the portion D1, as shown in FIG. 10), and the portion D2 has the same cross-sectional shape as the portion D1. Specifically, a width of the projecting portion 519 in the portion D2 is equal to that in the portion D1, and a width of the depressed portion 518 in the portion D2 is equal to that in the portion D1. Similarly, the portion D3 is adjacent to the portion D2 in the circumferential direction of the developing roller 510 (specifically, adjacent to a lower section of the portion D2, as shown in FIG. 10), and the portion D3 has the same cross-sectional shape as the portion D2 (the portion D1).

Figure 20A:
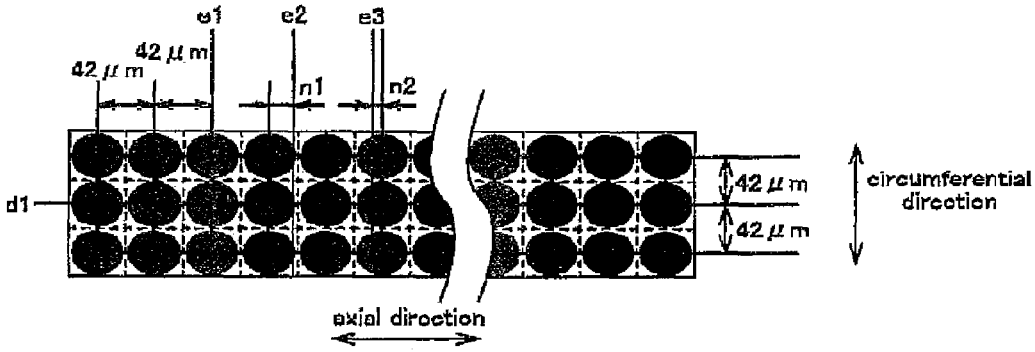
FIG. 20A is a (first) schematic diagram showing divided regions and dot-like latent images in the case of 600 dpi resolution.
Figure 20B:
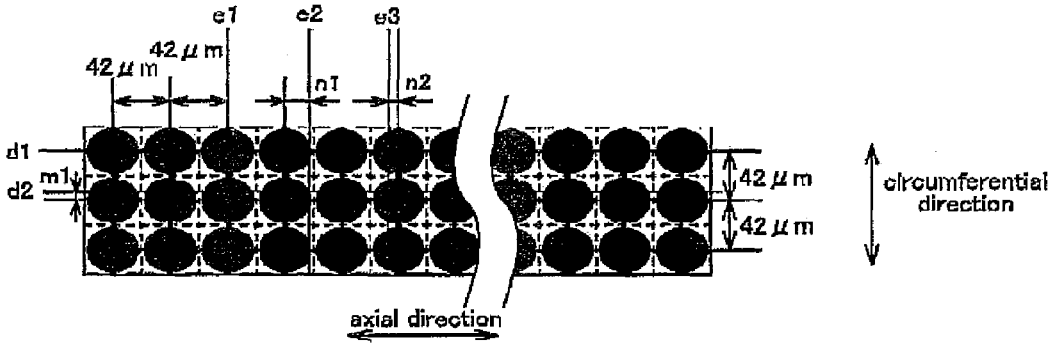
FIG. 20B is a (second) schematic diagram showing the divided regions and the dot-like latent images in the case of 600 dpi resolution.
Figure 20C:
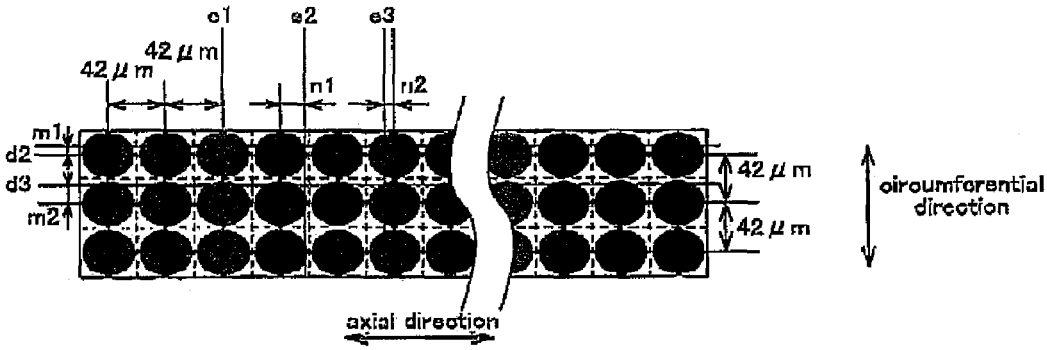
FIG. 20C is a (third) schematic diagram showing the divided regions and the dot-like latent images in the case of 600 dpi resolution.

FIGS. 20A through 20C are schematic diagrams showing divided regions and dot-like latent images in the case of 6 dpi resolution. FIG. 20A is a schematic diagram when the portion D1 is positioned at a position closest to the photoconductor 20. FIG. 20B is a schematic diagram when the developing roller 510 and the photoconductor 20 rotate further after a state shown in FIG. 20A and when the portion D2 is positioned at a position closest to the photoconductor 20. FIG. 20C is a schematic diagram when the developing roller 510 and the photoconductor 20 rotate further after a state shown in FIG. 20B and when the portion D3 is positioned at the position closest to the photoconductor 20. Note that, in FIGS. 20A through 20C, the axial direction and the circumferential direction of the photoconductor 20 are indicated by arrows.

In FIGS. 20A through 20C, each divided region is indicated by a square, and each dot-like latent image is indicated by a filled circle. A pitch of the divided regions is approximately 42 um both in the axial direction and in the circumferential direction. Each dot-like latent image is formed such that its center is positioned at a center of each divided region. Accordingly, each dot-like latent image is formed at a uniform spacing. Besides, in the case of 600 dpi resolution, dot-like latent images are uniform in size, and the size of the dot-like latent image shown in FIG. 20A, etc. is the smallest size which the printer 10 can form.

Further, a straight line d1, a straight line d2, and a straight line d3 are illustrated in FIGS. 20A, 20B, and 20C respectively. The straight line d1 indicates a position at which an opposing portion (hereinafter referred to as an opposing portion d1) opposes the portion D1 of the photoconductor 20, when the portion D1 is positioned at the position closest to the photoconductor 20. The straight line d2 indicates a position at which an opposing portion (hereinafter referred to as an opposing portion d2) opposes the portion D2 of the photoconductor 20, when the portion D2 is positioned at the position closest to the photoconductor 20. The straight line d3 indicates a position at which an opposing portion (hereinafter referred to as an opposing portion d3) opposes the portion D3 of the photoconductor 20, when the portion D3 is positioned at the position closest to the photoconductor 20.

In this case, the following three positional relationships are different from each other: a positional relationship, in the circumferential direction of the photoconductor 20, between the opposing portion d1 and the center of each divided region (FIG. 20A), a positional relationship, in the circumferential direction, between the opposing portion d2 and the center of each divided region (FIG. 20B), and a positional relationship, in the circumferential direction, between the opposing portion d3 and the center of each divided region (FIG. 20C). In other words, as shown in FIGS. 20A through 20C, while the opposing portion d1 is positioned at the center of each divided region, the opposing portion d2 and the opposing portion d3 are positioned away from the center of each divided region. A distance between the opposing portion d2 and the center of each divided region (distance ml in FIG. 20B) is shorter than a distance between the opposing portion d3 and the center of each divided region (distance m2 in FIG. 20C).

Further, the straight line d1 is also shown in FIG. 20B, and this straight line d1 indicates a position at which the opposing portion d1 in FIG. 20A is positioned after its movement in conjunction with the rotation of the photoconductor 20. A spacing between the portion D1 and the portion D2 (in this embodiment, the spacing is approximately 59.5 μm) is larger than a spacing between the straight line d1 and the straight line d2 (in this embodiment, the spacing is approximately 37 μm). This is because linear velocity of the developing roller 510 is faster than linear velocity of the photoconductor 20 (in this embodiment, the linear velocity of the developing roller 510 is 1.6 times the linear velocity of the photoconductor 20). Similarly, a spacing between the straight line d2 and the straight line d3 in FIG. 20C is the same as the spacing between the straight line d1 and the straight line d2 in FIG. 20B.

Positional Relationship, in Axial Direction of Photoconductor 20, between Indentation-Processed Section 512 and Divided Regions Next, with reference to FIGS. 10, 20A through 20C, this section describes a positional relationship, in the axial direction of the photoconductor 20, between the indentation-processed section 512 and the divided regions.

FIG. 10 illustrates straight lines E1, E2, E3 which are located at a uniform spacing, and these straight lines E1, E2, E3 indicate positions of respective portions, of the indentation-processed section 512, that are along the circumferential direction of the developing roller 510. Note that the portion whose position is indicated by the straight line E1 is referred to as a portion E1, the portion whose position is indicated by the straight line E2 is referred to as a portion E2, and the portion whose position is indicated by the straight line E3 is referred to as a portion E3, for the sake of convenience. In this case, the portion E1 and the portion E2 serve respectively as a circumferential-direction first portion and a circumferential-direction second portion.

The portion E1 is a portion that passes through either one of the two diagonal lines of the top surface 519*a* of the projecting portion 519, whichever is parallel to the circumferential direction, as shown in FIG. 10. The portion E2 is adjacent to the portion E1 in the axial direction of the developing roller 510 (specifically, adjacent to a right section of the portion E1, as shown in FIG. 10), and the portion E2 has the same cross-sectional shape as the portion E1. Specifically, the width of the projecting portion 519 in the portion E2 is equal to that in the portion E1, and the width of the depressed portion 518 in the portion E2 is equal to that in the portion E1. Similarly, the portion E3 is adjacent to the portion E2 in the axial direction of the developing roller 510 (specifically, adjacent to a right section of the portion E2, as shown in FIG. 10), and the portion E3 has the same cross-sectional shape as the portion E2 (the portion E1).

FIGS. 20A through 20C illustrate straight lines e1, e2, e3 which are located at a uniform spacing. The straight line el indicates a position of an opposing portion, of the photoconductor 20, that opposes the portion E1 of the developing roller 510 (hereinafter also referred to as an opposing portion e1). The straight line e2 indicates a position of an opposing portion, of the photoconductor 20, that opposes the portion E2 (hereinafter also referred to as an opposing portion e2). The straight line e3 indicates a position of an opposing portion, of the photoconductor 20, that opposes the portion E3 (hereinafter also referred to as an opposing portion e3).

In this case, as shown in FIG. 20A, the following three positional relationships are different from each other: a positional relationship, in the axial direction of the photoconductor 20, between the opposing portion e1 and the center of each divided region, a positional relationship, in the axial direction, between the opposing portion e2 and the center of each divided region, and a positional relationship, in the axial direction, between the opposing portion e3 and the center of each divided region. In other words, as shown in FIG. 20A, while the opposing portion e1 is positioned at the center of each divided region, the opposing portion e2 and the opposing portion e3 are positioned away from the center of each divided region. A distance between the opposing portion e2 and the center of each divided region (distance nl in FIG. 20A) is longer than a distance between the opposing portion e3 and the center of each divided region (distance n2 in FIG. 20A).

In the case of 200 dpi resolution

Next, positional relationship between the indentation-processed section 512 of the developing roller 510 and the divided regions in the case of 200 dpi resolution is described . Note that, in the same way as in the case of 600 dpi resolution, this section describes the positional relationship in the circumferential direction of the photoconductor 20 and the positional relationship in the axial direction of the photoconductor 20.

Positional Relationship, in Circumferential Direction of Photoconductor 20, between Indentation-Processed Section 512 and Divided Regions First, with reference to FIGS. 10, 21A through 21C, this section describes a positional relationship, in the circumferential direction of the photoconductor 20, between the indentation-processed section 512 and the divided regions.

Figure 21A:
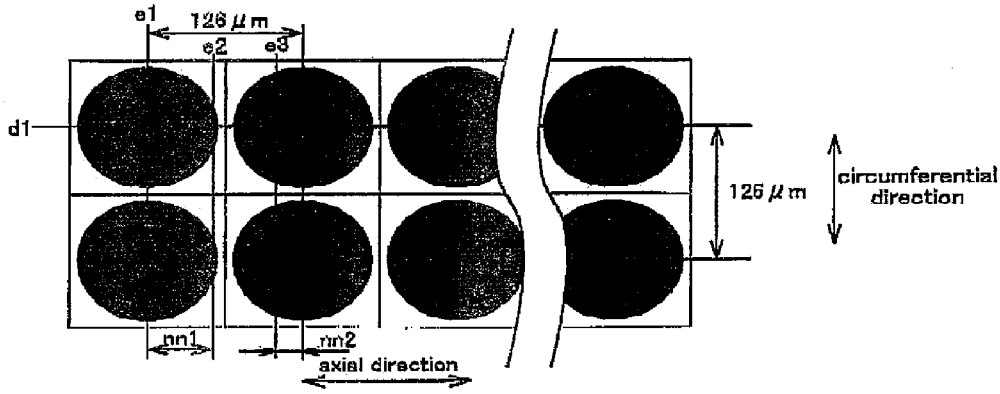
FIG. 21A is a (first) schematic diagram showing the divided regions and the dot-like latent images in the case of 200 dpi resolution.
Figure 21B:
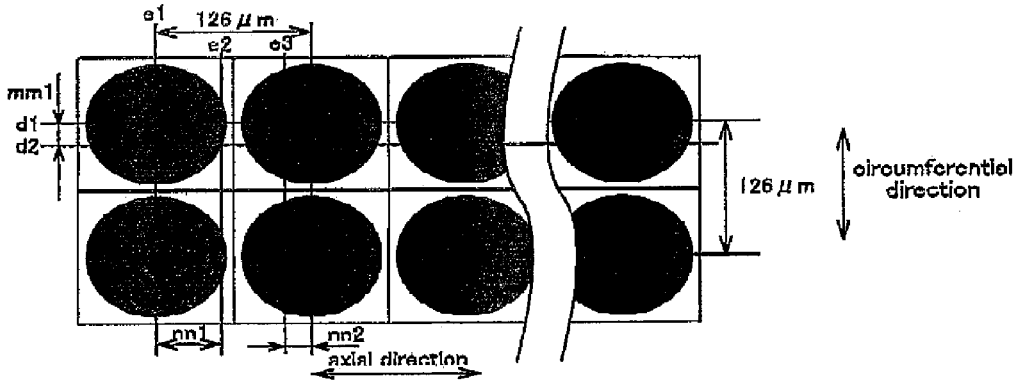
FIG. 21B is a (second) schematic diagram showing the divided regions and the dot-like latent images in the case of 200 dpi resolution.
Figure 21C:
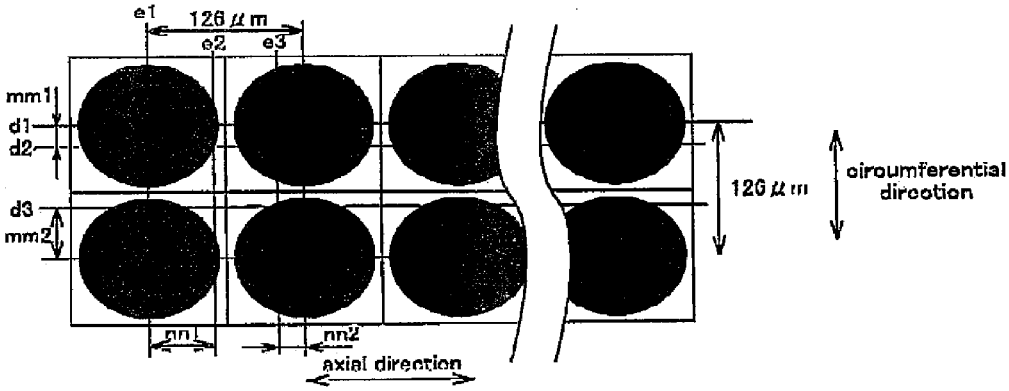
FIG. 21C is a (third) schematic diagram showing the divided regions and the dot-like latent images in the case of 200 dpi resolution.

FIGS. 21A through 21C are schematic diagrams showing the divided regions and the dot-like latent images in the case of 200 dpi resolution. FIG. 21A is a schematic diagram when the portion D1 (FIG. 10) is positioned at the position closest to the photoconductor 20. FIG. 21B is a schematic diagram when the developing roller 510 and the photoconductor 20 rotate further after a state shown in FIG. 21A and when the portion D2 (FIG. 10) is positioned at the position closest to the photoconductor 20. FIG. 21C is a schematic diagram when the developing roller 510 and the photoconductor 20 rotate further after a state shown in FIG. 21B and when the portion D3 (FIG. 10) is positioned at the position closest to the photoconductor 20. Note that, FIGS. 21A through 21C, the axial direction and the circumferential direction of the photoconductor 20 are indicated by arrows.

In FIGS. 21A through 21C, each divided region is indicated by a square, and each dot-like latent image is indicated by a filled circle. A pitch of the divided regions is approximately 126 μm both in the axial direction and in the circumferential direction. Each dot-like latent image is formed such that its center is positioned at a center of each divided region. Accordingly, each dot-like latent image is formed at a uniform spacing. Note that, in the case of 200 dpi resolution, dot-like latent images vary in size, and that the size of the dot-like latent image shown in FIG. 21A, etc. is the largest size which the printer 10 can form.

13 Further, a straight line d1, a straight line d2, and a straight line d3 are illustrated in FIGS. 21A, 21B, and 21C respectively. The straight line d1 indicates a position at which the the opposing portion d1 opposing the portion D1 of the photoconductor 20 is positioned when the portion D1 is positioned at the position closest to the photoconductor 20. The straight line d2 indicates a position at which the opposing portion d2 opposing the portion D2 of the photoconductor 20 is positioned when the portion D2 is positioned at the position closest to the photoconductor 20. The straight line d3 indicates a position at which the opposing portion d3 opposing the portion D3 of the photoconductor 20 is positioned when the portion D3 is positioned at the position closest to the photoconductor 20.

In this case, the following three positional relationships are different from each other: the positional relationship, in the circumferential direction of the photoconductor 20, between the opposing portion d1 and the center of each divided region (FIG. 21A), the positional relationship in the circumferential direction between the opposing portion d2 and the center of each divided region (FIG. 21B), and the positional relationship in the circumferential direction between the opposing portion d3 and the center of each divided region (FIG. 21C). In other words, as shown in FIGS. 21A through 21C, while the opposing portion d1 is positioned at the center of each divided region, the opposing portion d2 and the opposing portion d3 are positioned away from the center of each divided region. A distance between the opposing portion d2 and the center of each divided region (distance mm1 in FIG. 21B) is shorter than a distance between the opposing portion d3 and the center of each divided region (distance mm2 in FIG. 21C).

15 Further, the straight line d1 is also shown in FIG. 21B, and this straight line d1 indicates a position at which the opposing portion d1 in FIG. 21A is positioned after its movement in conjunction with the rotation of the photoconductor 20. A spacing between the portion D1 and the portion D2 (in this embodiment, the spacing is approximately 59.5 μm) is larger than a spacing between the straight line d1 and the straight line d2 (in this embodiment, the spacing is approximately 35 μm). This is because the linear velocity of the developing roller 510 is faster than the linear velocity of the photoconductor 20. Similarly, a spacing between the straight line d2 and the straight line d3 in FIG. 21C is the same as the spacing between the straight line d1 and the straight line d2 in FIG. 21B.

Note that, in this embodiment, a value (approximately 74 μm) which is a pitch PI, of the depressed portion 518 of the indentation-processed section 512, in the circumferential direction of the developing roller 510 (in this embodiment, 119μm), divided by a ratio (1.6) of a linear velocity of the surface of the developing roller 510 to a linear velocity of the surface of the photoconductor 20 is less than a longest pitch among a plurality of types of pitches of the lattices, that is, a pitch (126 μm) in the case of 200 dpi resolution.

Positional Relationship, in Axial Direction of Photoconductor 20, between Indentation-Processed Section 512 and Divided Regions Next, with reference to FIGS. 10, 21A through 21C, this section describes a positional relationship, in the axial direction of the photoconductor 20, between the indentation-processed section 512 and the divided regions.

FIGS. 21A through 21C illustrate straight lines e1, e2, e3 which are located at a uniform spacing. The straight line e1 indicates a position of an opposing portion, of the photoconductor 20, that opposes the portion E1 (FIG. 10) of the developing roller 510 (hereinafter also referred to as an opposing portion e1). The straight line e2 indicates a position of an opposing portion, of the photoconductor 20, that opposes the portion E2 (FIG. 10) (hereinafter also referred to as an opposing portion e2). The straight line e3 indicates a position of an opposing portion, of the photoconductor 20, that opposes the portion E3 (FIG. 10) (hereinafter also referred to as an opposing portion e3).

In this case, as shown in FIG. 21A, the following three positional relationships are different from each other: a positional relationship, in the axial direction of the photoconductor 20, between the opposing portion e1 and the center of each divided region, a positional relationship, in the axial direction, between the opposing portion e2 and the center of each divided region, and a positional relationship, in the axial direction, between the opposing portion e3 and the center of each divided region. In other words, as shown in FIG. 21A, while the opposing portion e1 is positioned at the center of each divided region, the opposing portion e2 and the opposing portion e3 are positioned away from the center of each divided region. A distance between the opposing portion e2 and the center of each divided region (distance nnl in FIG. 21A) is longer than a distance between the opposing portion e3 and the center of each divided region (distance nn2 in FIG. 21A).

Note that, in this embodiment, a pitch PI, in the axial direction of the developing roller 510, of the depressed portion 518 of the indentation-processed section 512 (119 μm) is less than the longest pitch among a plurality of types of the pitches of the lattices, that is, pitch (126 μm) in the case of 200 dpi resolution.

Regarding Effectiveness of Printer 10 according to Second Embodiment

As mentioned above, in the image forming apparatus (the printer 10) according to this embodiment, as shown in FIGS. 20A through 20C, 21A through 21C, regarding the positional relationship (FIG. 20A), in the circumferential direction of the photoconductor 20, between the center of each of the divided regions and the opposing portion (the opposing portion d1), of the photoconductor 20, that opposes the axial-direction first portion (for example, the portion D1) of a depressed/projecting section (the indentation-processed section 512) when the axial-direction first portion is positioned at a position closest to an image bearing body (the photoconductor 20), the axial-direction first portion being along an axial direction of a developer bearing roller (the developing roller 510), the positional relationship (FIG. 20A) is different from a positional relationship (FIG. 20B), in the circumferential direction, between the center of each divided region and the opposing portion (the opposing portion d2), of the photoconductor 20, that opposes the axial-direction second portion (for example, the portion D2) of the indentation-processed section 512 when the axial-direction second portion is positioned at the position closest to the photoconductor 20 with the rotation of the developing roller 510, and the axial-direction second portion being along the axial direction of the developing roller 510 and being in a same shape as the portion D1. This enables to reduce deterioration of image quality. This is described below in details.

If the developing roller 510 has the indentation-processed section 512 formed on the surface thereof, when the dot-like latent images are made visible as a toner image by the developing roller 510, unevenness in density caused by the indentation-processed section 512 (the form of the surface) may occur periodically in the toner image (for example, unevenness in density which is caused because the amount of toner borne by the projecting portion 519 is different from the amount of toner borne by the depressed portion 518). The periodic occurrence of conspicuous unevenness in density results in deterioration of image quality.

Figure 22A:
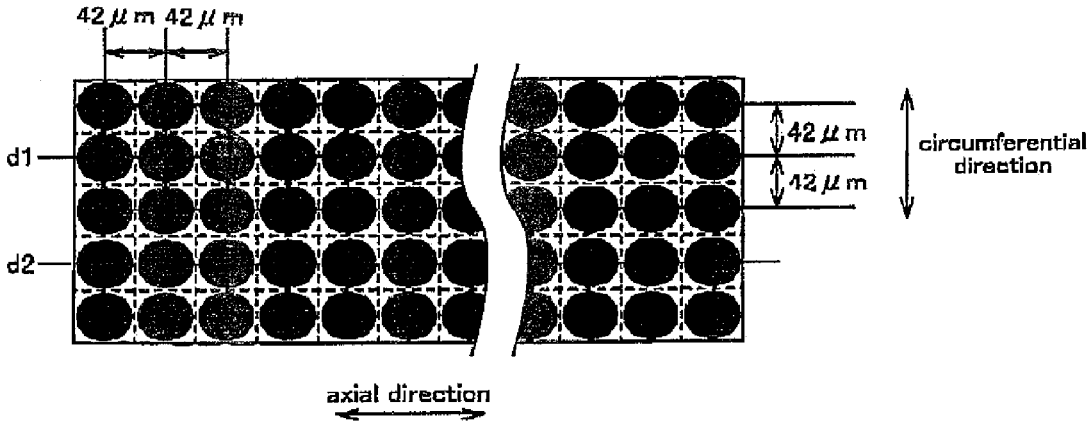
FIG. 22A is a (first) diagram showing a comparison example according to the second embodiment.
Figure 22B:
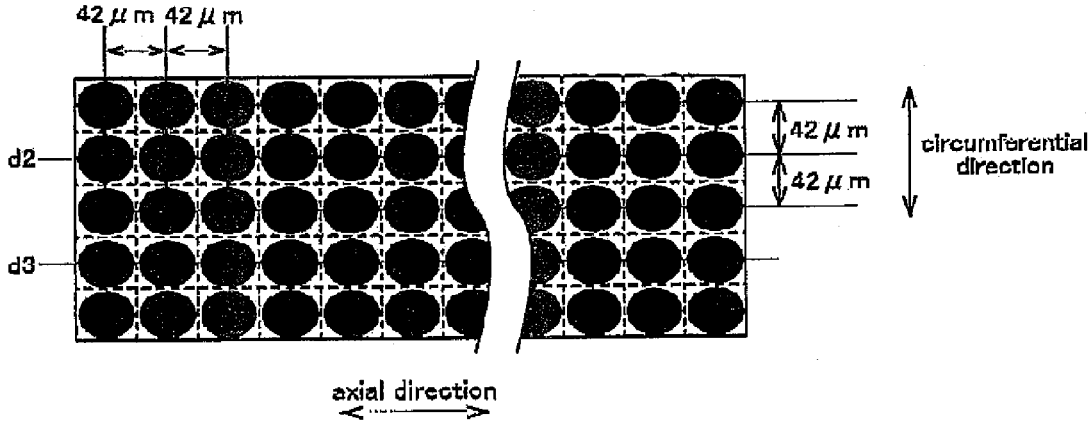
FIG. 22B is a (second) diagram showing the comparison example according to the second embodiment.

This is specifically described with reference to FIGS. 22A and 22B. FIGS. 22A and 22B are diagrams showing a comparison example. FIG. 22A is a diagram similar to FIG. 20B (i.e., a schematic diagram showing a state when the portion D2 (FIG. 10) is positioned at the position closest to the photoconductor 20). Also, FIG. 22B is a diagram similar to FIG. 20C (i.e., a schematic diagram showing a state when the portion D3 (FIG. 10) is positioned at the position closest to the photoconductor 20). As shown in FIGS. 22A and 22B, the opposing portions d1, d2, d3 pass through the centers of the divided regions in the circumferential direction respectively. In short, the following three positional relationships are the same: the positional relationship, in the circumferential direction of the photoconductor 20, between the opposing portion d1 and the center of each divided region, the positional relationship, in the circumferential direction, between the opposing portion d2 and the center of each divided region, and the positional relationship, in the circumferential direction, between the opposing portion d3 and the center of each divided region. In such a case, the dot-like latent images of the second row in FIG. 22A, the dot-like latent images of the fourth row in FIG. 22A, and the dot-like latent images of the fourth row in FIG. 22B are made visible as a toner image by toner borne on respective portions, of the indentation-processed section 512, that have a same cross-sectional shape (the dot-like latent images of the fourth row in FIG. 22A is the same as the dot-like latent image in the second row in FIG. 22B). In this case, there are cases in which, an area in the toner image that is obtained by developing the dot-like latent images of the above mentioned three rows becomes conspicuous as unevenness in density, and this may result in deterioration of image quality.

In contrast, in the printer 10 according to this embodiment, the positional relationship, in the circumferential direction of the photoconductor 20, between the opposing portion d1 and the center of each divided region is different from the positional relationship, in the circumferential direction, between the opposing portion d2 and the center of each divided region. In other words, the opposing portion d1 and the center of each divided region are in a positional relationship in which the opposing portion d1 passes through that center, as shown in FIG. 20A. The opposing portion d2 and the center of each divided region are in a positional relationship in which the opposing portion d2 is positioned away from that center, as shown in FIG. 20B. In such a case, a plurality of dot-like latent images which are lined in the circumferential direction of the photoconductor 20 are respectively made visible as a toner image by toner borne on respective portions, of the indentation-processed section 512, that have a different cross-sectional shape. Accordingly, it is possible to reduce deterioration of image quality because an area in the toner image which is obtained by developing a plurality of the dot-like latent images lined in the circumferential direction can be suppressed from becoming conspicuous as unevenness in density.

Further, as mentioned above, in the printer 10 according to this embodiment, as shown in FIGS. 20A, 21A, etc., regarding a positional relationship, in the axial direction of the photoconductor 20, between the center of each divided region and an opposing portion (the opposing portion e1), of the photoconductor 20, that opposes a circumferential-direction first portion (for example, the portion E1) of the indentation-processed section 512, the circumferential-direction first portion being in the circumferential direction of the developing roller 510, the positional relationship is different from a positional relationship, in the axial direction of the photoconductor 20, between the center of each divided region and an opposing portion (the opposing portion e2), of the photoconductor 20, that opposes a circumferential-direction second portion (for example, the portion E2) of the indentation-processed section 512, the circumferential-direction second portion being along the circumferential direction of the developing roller 510 and adjacent to the portion E1 in the axial direction of the developing roller 510 and being in the same shape as the portion E1.

In short, as shown in FIG. 20A, the opposing portion e1 and the center of each divided region are in a positional relationship in which the opposing portion e1 passes through that center, and the opposing portion e2 and the center of each divided region are in positional relationship in which the opposing portion e2 is positioned away from that center. In such a case, a plurality of dot-like latent images which are lined in the axial direction of the photoconductor 20 are respectively made visible as a toner image by toner borne on respective portions, of the indentation-processed section 512, that have a different cross-sectional shape. Accordingly it is possible to reduce deterioration of image quality because an area in the toner image that is obtained by developing a plurality of the dot-like latent images lined in the axial direction can suppressed from becoming conspicuous as unevenness in density.

Note that, in the above-mentioned embodiment, the indentation-processed section 512 has a helical groove portion thereon as the depressed portion 518, the helical groove portion having an inclination with respect to the axial direction of the developing roller 510 and being formed having a uniform pitch in the axial direction. Besides, the groove portion (the depressed portion 518) is formed as two types whose angle of the inclination is different from each other, and two types of the groove portions intersect and form lattices. Further, the projecting portion 519 of the indentation-processed section 512 is surrounded by the two types of the groove portions. However, this invention is not limited thereto. For example, it is possible that the groove portion (the depressed portion 518) is not formed having a uniform pitch in the axial direction.

However, if the groove portion (the depressed portion 518) is formed having a uniform pitch in the axial direction, periodic unevenness in density is likely to be caused by the form of the surface of the developing roller 510 because the depressed portion 518 and the projecting portion 519 are provided regularly. This makes the effect to make unevenness in density less conspicuous be achieved more advantageously. Accordingly, the above-mentioned embodiment is more desirable.

Besides, in the above-mentioned embodiment, as shown in FIGS. 20A and 21A, the lattices which form the divided regions can be formed at a plurality of types of the pitches in the circumferential direction of the surface of the photoconductor 20. Further, a value which is a pitch of the groove portion, in the circumferential direction, divided by a ratio of a moving speed of the surface of the developing roller 510 to a moving speed of the surface of the photoconductor 20 is less than the longest pitch among a plurality of types of the pitches of the lattices. However, this invention is not limited thereto. For example, the value can be more than the longest pitch of the lattices.

On the surface of the developing roller 510, the depressed portion 518 bears a larger amount of toner than the projecting portion 519. Thus, in development of dot-like latent images, an area which is positioned opposite the depressed portion 518 may be slightly darker in density. If the value is more than the longest pitch among a plurality of types of the pitches of the lattices, when developing dot-like latent images which are formed respectively in regions divided into lattices, some dots are formed by a section which includes the depressed portion 518 and the other dots are formed by a section which does not include the depressed portion 518 (i.e., by only the projecting portion 519). In this case, periodic unevenness in density occurs in a toner image which is obtained by developing the dot-like latent images. In contrast, in the above-mentioned embodiment (i.e., the value is more than the longest pitch of the lattices), all dots which are obtained by developing the respective dot-like latent images are formed by the section which includes the depressed portion 518 of the developing roller 510. This enables to reduce the occurrence of unevenness in density, in the developed toner image, caused by the depressed portion 518. Accordingly, the above-mentioned embodiment is more desirable.

Furthermore, in the above-mentioned embodiment, as shown in FIGS. 20A and 21A, the lattices which form the divided regions can be formed at a plurality of types of the pitches in the axial direction of the surface of the photoconductor 20. In addition, the pitch of the groove portion, in the axial direction, is less than the longest pitch among a plurality of types of the pitches of the lattices. However, this invention is not limited thereto. For example, the pitch of the depressed portion 518 can be more than the longest pitch of the lattices.

On the surface of the developing roller 510, the depressed portion 518 bears a larger amount of toner than the projecting portion 519. Thus, in developing dot-like latent images, an area which is positioned opposite the depressed portion 518 may be slightly darker in density. If the pitch of the depressed portion 518, in the axial direction, is more than the longest pitch among a plurality of types of the pitches of the lattices, when developing dot-like latent images which are formed respectively in regions divided into lattices, some dots are formed by the section which includes the depressed portion 518 and the other dots are formed by the section which does not include the depressed portion 518 (i.e., by only the projecting portion 519). In this case, periodic unevenness in density occurs in a toner image which is obtained by developing the dot-like latent images. In contrast, in the above-mentioned embodiment (i.e., the pitch of the depressed portion 518 is more than the longest pitch of the lattices), all dots which are obtained by developing the respective dot-like latent images are formed by the section which includes the depressed portion 518 of the developing roller 510. This enables to reduce the occurrence of unevenness in density, in the developed toner image, caused by the depressed portion 518. Accordingly, the above-mentioned embodiment is more desirable.

Figure 23:
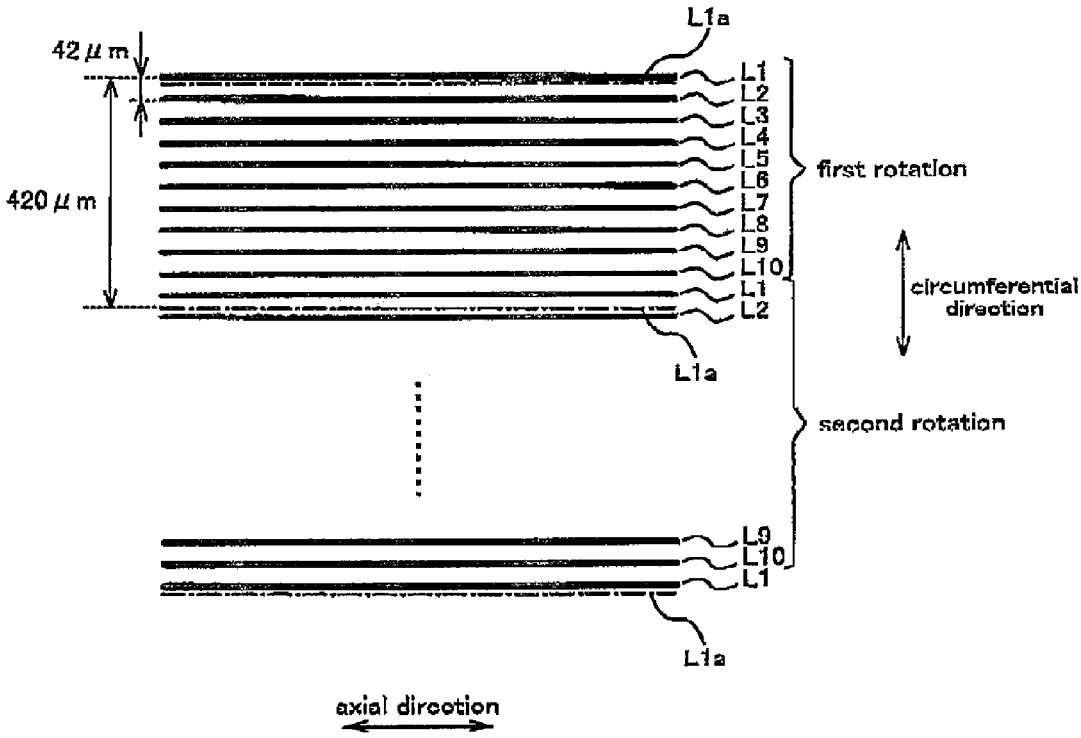
FIG. 23 is a schematic diagram showing line images which are dot-like latent images formed on a photoconductor 20.

Regarding Relationship Between Unevenness in Density Caused by Inclination of Mirror Faces 44 and Unevenness in Density Caused by Shape of Indentation-Processed Section 512 in Printer 10 According to Second Embodiment As mentioned above, the exposing unit 40 successively emits, onto the photoconductor 20, laser beam reflected by each of the mirror faces 44 in the rotation of the polygon mirror 43, and forms dot-like latent images on the photoconductor 20. As a result thereof, the dot-like latent images are formed lining in the axial direction of the photoconductor 20, as shown in FIG. 23. FIG. 23 shows the dot-like latent images which are formed at a predetermined spacing in the circumferential direction. More specifically, FIG. 23 shows the dot-like latent images which are formed by laser beam reflected by the mirror face 44*a* (the dot-like latent images indicated by a straight line L1 in FIG. 23, hereinafter referred to as dot-like latent images L1), the dot-like latent images which are formed by laser beam reflected by the mirror faces 44*b* (dot-like latent images indicated by a straight line L2 in FIG. 23, hereinafter referred to as a dot-like latent images L2), and the like. Note that, a spacing of the dot-like latent images in the circumferential direction is approximately 42 μm. Spacing between the dot-like latent images L1 by first rotation of the polygon mirror 43 and the dot-like latent images L1 by second rotation of the polygon mirror 43 is approximately 420 μm. In short, every approximately 420 μm, the dot-like latent images are formed by a same mirror face among the mirror faces 44.

There are cases in which, among a plurality of the mirror faces 44 of the polygon mirror 43, some mirror face is inclined with respect to the rotating shaft of the polygon mirror 43. In the below description, the inclined mirror faces 44 serves as the mirror face 44*a*. The dot-like latent images L1 formed by laser beam reflected by this mirror face 44*a* is formed at a position where is shifted from a predetermined position of the photoconductor 20 (the shifted dot-like latent images L1 is indicated by dot-like latent images L1*a* in FIG. 23). If the dot-like latent images Li shift towards the dot-like latent images L2 as shown in FIG. 23, a spacing between the dot-like latent images Li and the dot-like latent images L2 become narrow, and this makes the density darker. As a result thereof, unevenness in density may occur. Besides, this shift of the dot-like latent images (i.e., dot-like latent images L1*a*) is caused every one rotation of the polygon mirror 43, as shown in FIG. 23. Therefore, unevenness in density occurs periodically.

Further, as mentioned above, if the indentation-processed section 512 is formed on the surface of the developing roller 510, there are cases in which, when the developing roller 510 makes visible dot-like latent images as a toner image, unevenness in density caused by the indentation-processed section 512 (the form of the surface) may occur periodically in the toner image (for example, unevenness in density which is caused because the amount of toner borne by the projecting portion 519 is different from the amount of toner borne by the depressed portion 518). The periodic occurrence of the above-mentioned two types of unevenness in density makes unevenness in density more conspicuous, and this may result in deterioration of image quality.

Accordingly, in the printer 10 according to this embodiment, in order to reduce deterioration of image quality, the indentation-processed section 512 has a shape described below.

Figure 24:
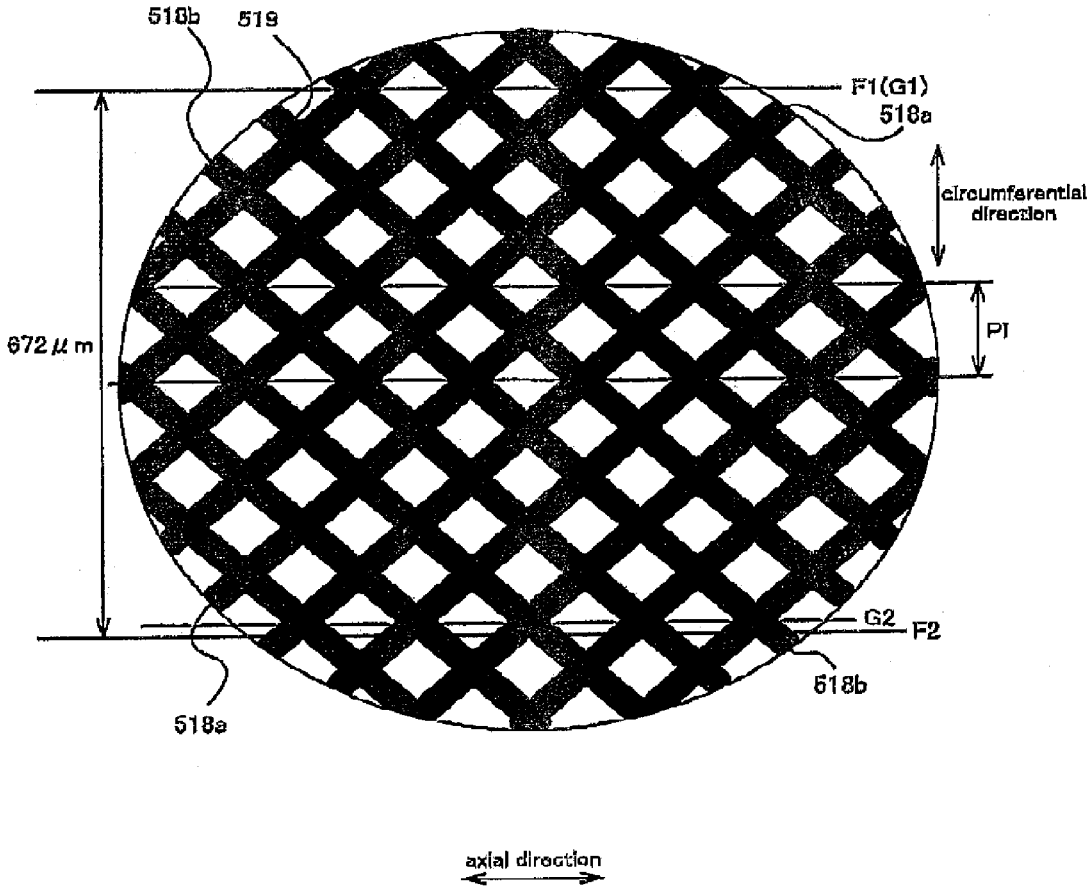
FIG. 24 is a schematic diagram showing the surface of the developing roller 510 according to the second embodiment.

FIG. 24 is a schematic diagram showing the surface of the developing roller 510. FIG. 24 shows straight lines Fl and F2. The straight line Fl indicates a position of an opposing portion (hereinafter also referred to as an opposing portion Fl), of the developing roller 510, that opposes a center of each of those divided regions, when the center of divided regions which bear dot-like latent images formed by a laser beam which is reflected by the inclined mirror face 44*a* among a plurality of the mirror faces 44, is positioned at a position closest to the developing roller 510. The straight line F2 indicates a position of an opposing portion (hereinafter also referred to as an opposing portion F2), of the developing roller 510, that opposes a center of each of those divided regions, when the center of divided regions which bear dot-like latent images formed by a laser beam which is reflected by the mirror face 44*a* after one rotation of the polygon mirror 43, is positioned at the above-mentioned position closest to the developing roller 510. Note that a spacing between the opposing portion F1 and the opposing portion F2 is approximately 672 μm (a value that is 1.6 times of 420 μm shown in FIG. 23) because the linear velocity of the surface of the developing roller 510 is 1.6 times as the linear velocity of the surface of the photoconductor 20.

Further, straight lines G1, G2 are illustrated in FIG. 24. The straight lines G1 and G2 indicate positions of respective portions, of the indentation-processed section 512, that are along the axial direction of the developing roller 510. Note that the portion whose position is indicated by the straight line G1 is referred to as a portion G1, and the portion whose position is indicated by the straight line G2 is referred to as a portion G2, for the sake of convenience. The portion G1 and the portion G2 are portions that pass through either one of the two diagonal lines of the top surface 519*a* of the projecting portion 519, whichever is parallel to the axial direction, as shown in FIG. 24. Note that, in this embodiment, the portion G1 serves as the axial-direction first portion and the portion G2 serves as and the axial-direction second portion.

In this embodiment, a positional relationship, in the circumferential direction of the developing roller 510, between the opposing portion Fl and the portion Gi is different from a positional relationship, in the circumferential direction, between the opposing portion F2 and the portion G2. In other words, the opposing portion F1 and the portion G1 are in a positional relationship in which the opposing portion F1 passes through the portion G1. The opposing portion F2 and the portion G2 are in a positional relationship in which the opposing portion F2 is positioned away from the portion G2. In such a case, dot-like latent images which are formed by a laser beam reflected by the mirror face 44*a* every one rotation of the polygon mirror 43 are made visible as a toner image by toner borne on respective portions, of the indentation-processed section 512, that have a different cross-sectional shape. Accordingly, it is possible to reduce deterioration of image quality because an area in the toner image which is obtained by developing dot-like latent images which are formed every one rotation of the polygon mirror 43 is suppressed from becoming conspicuous as unevenness in density.

Other Embodiments

In the foregoing, an image forming apparatus etc. according to the present invention was described according to the above-mentioned embodiments thereof. However, the foregoing embodiments of the invention are for the purpose of facilitating understanding of the present invention and not to be interpreted as limiting the present invention. The present invention can be altered and improved without departing from the gist thereof, and needless to say, the present invention includes its equivalents.

In the foregoing embodiments, the computer 702 includes the image processing section 797, but this invention is not limited thereto. For example, the printer 10 can include the image processing section 797.

In the foregoing embodiments, an intermediate transferring type full-color laser beam printer was described as an example of an image forming apparatus. However, the present invention is also applicable to various other types of image forming apparatuses such as full-color laser beam printers that are not of the intermediate transferring type, monochrome laser beam printers, copying machines, and facsimiles.

Further, a photoconductor is not limited to a so-called photoconductive roller structured by providing a photoconductive layer on the outer peripheral surface of a cylindrical conductive base, and can be a so-called photoconductive belt structured by providing a photoconductive layer on the surface of belt-like conductive base.

In the foregoing embodiments, a four-color toner image is made visible on one photoconductor 20, but this invention is not limited thereto. For example, it is also possible that the printer 10 includes four photoconductors 20 on which toner images of different colors are made visible respectively.

Further, in the foregoing embodiments, the developing roller 510 includes the cylindrical portion 510*a* having the above-mentioned surface and the cylindrical portion 510*a* is made of a single material, but this invention is not limited thereto. For example, the cylindrical portion 510*a* can be made of a plurality of materials.

However, if the cylindrical portion 510*a* is made of a single material, it is possible to easily manufacture the developing roller 510 which includes the above-mentioned projecting portion 519. Accordingly, the above-mentioned embodiment is more desirable.

Further, in the foregoing embodiments, the printer 10 includes the layer-thickness restriction member (the restriction blade 560) for restricting the layer thickness of the developer borne by the developing roller 510, by abutting against the developing roller 510 contiguously from one end section in the axial direction of the developing roller 510 to the other end section. The restriction blade 560 restricts the layer thickness by causing a flat surface of the restriction blade 560 to abut against the developing roller 510. However, this invention is not limited thereto. For example, it is also possible that the restriction blade 560 does not restrict the layer thickness.

Furthermore, in the foregoing embodiments, the toner T is a particulate and the depth of the depressed portion 518 is equal to or less than twice the volume-weighted average diameter of the toner T, but this invention is not limited thereto. For example, the depth of the depressed portion 518 can be more than twice the volume-weighted average diameter of the toner T.

If the depth of the depressed portion 518 is equal to or less than twice the volume-weighted average diameter of the toner, the toner can be charged appropriately because a large amount of the toner which is located in the depressed portion 518 and between the developing roller 510 and the rubber section 562 are in contact with at least either one of the developing roller 510 and the rubber section 562. Considering this point, the above-mentioned embodiment is more desirable. Note that, if the depth of the depressed portion 518 is equal to or less than one time the volume-weighted average diameter of the toner, it is more desirable because a large amount of the toner which is located in the depressed portion 518 and between the developing roller 510 and the rubber section 562 are in contact with both of the developing roller 510 and the rubber section 562.

What is claimed is:

1. An image forming apparatus comprising:

an image bearing body that is rotatable about a central axis thereof, and that bears a dot-like latent image, on a surface of the image bearing body, in each of a plurality of divided regions that are arranged in rows along a direction that intersects an axial direction of the central axis at a predetermined intersection angle; and a developer bearing roller that is rotatable in order to make visible, as a developer image, the dot-like latent images borne by the image bearing body, using a developer borne on a surface of the developer bearing roller, the developer bearing roller opposing the image bearing body such that an axial direction of the developer bearing roller is parallel to the axial direction of the image bearing body, and that includes a helical groove portion on the surface of the developer bearing roller, the helical groove portion being inclined at a predetermined inclination angle with respect to the axial direction of the developer bearing roller and being formed having a uniform pitch in the axial direction, wherein a value that is a tangent of the inclination angle divided by a ratio of a moving speed of the surface of the developer bearing roller to a moving speed of the surface of the image bearing body is different from a tangent of the intersection angle.

2. An image forming apparatus according to claim 1, wherein:

the developer is a first developer;

a plurality of the divided regions form divided-region groups;

the divided-region groups are a first divided-region group that bears dot-like latent images that are to be made visible as a developer image by the first developer, and a second divided-region group that bears dot-like latent images that are to be made visible as a developer image by a second developer whose color is different from a color of the first developer; and the value that is the tangent of the inclination angle divided by a ratio of the moving speed of the surface of the developer bearing roller to the moving speed of the surface of the image bearing body is different from the tangent of the intersection angle of the first divided-region group and is different from the tangent of the intersection angle of the second divided-region group.

3. An image forming apparatus according to claim 2, wherein:

the image forming apparatus can form a color image by developers of four colors that include the first developer and the second developer;

the divided-region groups are four divided-region groups that each bear the dot-like latent images to be made visible as a developer image by the developer of each of the four colors; and the value that is the tangent of the inclination angle divided by a ratio of the moving speed of the surface of the developer bearing roller to the moving speed of the surface of the image bearing body is different from a tangent of the intersection angle of each of the four divided-region groups.

4. An image forming apparatus according to claim 3, wherein:

the intersection angle of each of the four divided-region groups is different from each other;

the image forming apparatus includes four developer bearing rollers that bear the developer of each of the four colors;

an inclination angle of the groove portion of each of the four developer bearing rollers is the same as each other; and a value that is each a tangent of the inclination angle of the groove portion of each of the four developer bearing rollers, divided by a ratio of the moving speed of a surface of each developer bearing roller to the moving speed of the surface of the image bearing body is different from the tangent of the intersection angle of any of the four divided-region groups.

5. An image forming apparatus according to claim 1, wherein:

the developer is a first developer;

the developer bearing roller is a first developer bearing roller;

the image forming apparatus includes a second developer bearing roller that has the groove portion and that bears a second developer whose color is different from the color of the first developer; and the inclination angle of the groove portion of the second developer bearing roller is different from the inclination angle of the groove portion of the first developer bearing roller.

6. An image forming apparatus according to claim 5, wherein:

a plurality of the divided regions form divided-region groups;

the divided-region groups are a first divided-region group that bears dot-like latent images that are to be made visible as a developer image by the first developer, and a second divided-region group that bears dot-like latent images that are to be made visible as a developer image by the second developer; and a value that is the tangent of the inclination angle of the groove portion of the second developer bearing roller divided by a ratio of a moving speed of a surface of the second developer bearing roller to a moving speed of the surface of the image bearing body is different from the tangent of the intersection angle of the first divided-region group.

7. An image forming apparatus according to claim 6, wherein:

the image forming apparatus can form a color image by developers of four colors that include the first developer and the second developer;

the image forming apparatus includes four developer bearing rollers that include the first developer bearing roller and the second developer bearing roller and that bear the developer of each of the four colors; and the inclination angle of the groove portion of each of the four developer bearing rollers is different from each other.

8. An image forming apparatus according to claim 6, wherein:

the image forming apparatus can form a color image by developers of four colors that include the first developer and the second developer;

the image forming apparatus includes four developer bearing rollers that include the first developer bearing roller and the second developer bearing roller and that bear the developers of each of the four colors; and the inclination angle of the groove portion of each of two developer bearing rollers among the four developer bearing rollers is the same as each other.

9. An image forming apparatus according to claim 7, wherein:

the divided-region groups are four divided-region groups that each bear the dot-like latent images to be made visible as a developer image by the developers of each of the four colors;

the intersection angle of each of the four divided-region groups is different in degree from each other; and a value that is each a tangent of the inclination angle of the groove portion of each of the four developer bearing rollers, divided by a ratio of a moving speed of a surface of each developer bearing roller to a moving speed of the surface of the image bearing body is different from the tangent of the intersection angle of any of the four divided-region groups.

10. An image forming apparatus according to claim 7, wherein:

the divided-region groups are four divided-region groups that each bear the dot-like latent images to be made visible as a developer image by the developers of each of the four colors; and the intersection angle of each of the four divided-region groups is the same as each other.

11. An image forming apparatus according to claim 1, wherein:

the developer bearing roller includes a cylindrical portion having the surface; and the cylindrical portion is made of a single material.

12. An image forming apparatus according to claim 1, wherein:

the image forming apparatus further includes a layer-thickness restriction member that is for restricting a layer thickness of the developer borne on the developer bearing roller, by abutting against the developer bearing roller contiguously from one end section in the axial direction of the developer bearing roller to the other end section; and the layer-thickness restriction member restricts the layer thickness by abutting against the developer bearing roller with a flat surface of the layer-thickness restriction member.

13. An image forming apparatus comprising:

a rotatable image bearing body that is for bearing dot-like latent images in divided regions that has been divided into lattices; and a rotatable developer bearing roller that includes a depressed and projecting section on a surface thereof, and that is for making visible, by bearing a developer on the surface, as a developer image the dot-like latent images that are borne by the image bearing body, wherein a positional relationship, in a circumferential direction of the image bearing body, between a center of each of the divided regions and an opposing portion, of the image bearing body, that opposes an axial-direction first portion of the depressed and projecting section when the axial-direction first portion is positioned at a position closest to the image bearing body, the axial-direction first portion being along an axial direction of the developer bearing roller, is different from a positional relationship, in the circumferential direction, between the center of each of the divided regions and an opposing portion, of the image bearing body, that opposes an axial-direction second portion of the depressed and projecting section when the axial-direction second portion is positioned at the position closest to the image bearing body with rotation of the developer bearing roller, the axial-direction second portion being along the axial direction of the developer bearing roller and being a sane shape as the axial-direction first portion.

14. An image forming apparatus according to claim 13, wherein:

the depressed and projecting section has a helical groove portion formed thereon as a depressed portion, the groove portion having an inclination with respect to the axial direction of the developer bearing roller and being formed having a uniform pitch in the axial direction;

two types of the groove portions are formed, an angle of the inclination of each of the types being different from each other;

the two types of the groove portions intersect each other and form lattices; and a projecting portion of the depressed and projecting section is provided surrounded by the two types of the groove portions.

15. An image forming apparatus according to claim 14, wherein:

the lattices that form the divided regions can be formed at a plurality of types of pitches in a circumferential direction of a surface of the image bearing body; and a value that is a pitch of the groove portion, in the circumferential direction, divided by a ratio of a moving speed of the surface of the developer bearing roller to a moving speed of the surface of the image bearing body is less than a longest pitch among a plurality of the types of the pitches of the lattices.

16. An image forming apparatus comprising:

an image bearing body that is for bearing dot-like latent images in divided regions that has been divided into lattices; and a developer bearing roller that includes a depressed and projecting section on a surface thereof, and that is for making visible, by bearing a developer on the surface, as a developer image the dot-like latent images that are borne by the image bearing body, wherein a positional relationship, in an axial direction of the image bearing body, between a center of each of the divided regions and an opposing portion, of the image bearing body, that is opposed to a circumferential-direction first portion of the depressed and projecting section, and the circumferential direction first portion being along a circumferential direction of the developer bearing roller, is different from a positional relationship, in the axial direction of the image bearing body, between the center of each of the divided regions and an opposing portion, of the image bearing body, that is opposed to a circumferential-direction second portion of the depressed and projecting section, the circumferential-direction second portion being along the circumferential direction of the developer bearing roller and adjacent to the circumferential-direction first portion in an axial direction of the developer bearing roller and being a same shape as the circumferential-direction first portion.

17. An image forming apparatus according to claim 16, wherein:

the depressed and projecting section has a helical groove portion formed thereon as a depressed portion, the groove portion having an inclination with respect to the axial direction of the developer bearing roller and being formed having a uniform pitch in the axial direction;

two types of the groove portions are formed, an angle of the inclination of each of the types being different from each other;

the two types of the groove portions intersect each other and form lattices; and a projecting portion of the depressed and projecting section is provided surrounded by the two types of the groove portions.

18. An image forming apparatus according to claim 17, wherein:

the lattices that form the divided regions can be formed at a plurality of types of pitches in an axial direction of a surface of the image bearing body; and a pitch of the groove portion, in the axial direction, is less than a longest pitch among a plurality of the types of the pitches of the lattices.

19. An image forming apparatus according to claim 13, wherein:

the developer bearing roller includes a cylindrical portion having the surface; and the cylindrical portion is made of a single material.

20. An image forming apparatus according to claim 13, wherein:

the image forming apparatus further includes a layer-thickness restriction member that is for restricting a layer thickness of the developer borne on the developer bearing roller, by abutting against the developer bearing roller contiguously from one end section in the axial direction of the developer bearing roller to the other end section; and the layer-thickness restriction member restricts the layer thickness by abutting against the developer bearing roller with a flat surface of the layer-thickness restriction member.

* * * * *